US005367836A

United States Patent [19]

Allen

[11] Patent Number: 5,367,836

[45] Date of Patent: Nov. 29, 1994

[54] AUTOMATIC DRILL LOADER

[75] Inventor: Kenneth H. Allen, Hendersonville, N.C.

[73] Assignee: Giddings & Lewis, Inc., Fond du Lac, Wis.

[21] Appl. No.: 882,947

[22] Filed: May 14, 1992

[51] Int. Cl.[5] ..... B24B 3/26; B24B 47/00

[52] U.S. Cl. ..... 451/331; 76/5.1; 76/108.6; 414/225; 414/226; 414/222; 414/746.3; 414/746.4; 198/540; 198/543; 451/335; 451/339; 451/375

[58] Field of Search ..... 51/215 R, 215 UE, 215 CP, 51/215 H, 288; 414/222, 225, 226, 224, 746.3, 746.4; 901/6, 7; 76/5.1, 108.6, 108.1, 108.2, 108.4; 198/540, 543

[56] References Cited

U.S. PATENT DOCUMENTS

| | | | |
|---|---|---|---|
| 1,288,125 | 12/1918 | Muller | 51/215 H |
| 3,618,741 | 11/1971 | Berndt | 414/746.4 |
| 3,954,164 | 5/1976 | Bottomley | 51/215 H |
| 4,001,983 | 1/1977 | Farrot | 51/215 UE |
| 4,388,039 | 6/1983 | Schwarze | 198/543 |
| 4,837,983 | 6/1989 | Fuller, Jr. | 414/225 |

*Primary Examiner*—Jack W. Lavinder

*Attorney, Agent, or Firm*—Foley & Lardner

[57] ABSTRACT

An automatic drill loader is used with a drill grinding machine to automatically present drills to the drill grinding machine workhead for being ground thereat and to carry ground drills to a storage receptacle. The automatic drill loader comprises a magazine, a timing station, and two sets of grippers. The magazine stores a quantity of drills, which may have stepped shanks. The magazine is adjustable to suit drills of different lengths and diameters. The magazine presents one drill at a time to a staging station. A load gripper grips the drill at the staging station and conveys it to the timing station, whereat the drill is linearly and angularly oriented. The load gripper then transports the drill to the drill grinding machine workhead. Simultaneously, an unload gripper carries a ground drill from the drill grinding machine workhead to the storage receptacle. After the load gripper has transported the timed drill to the drill grinding machine workhead, the load gripper returns to the staging station to grip another drill. Simultaneously, the unload gripper returns to the workhead to grip and remove the finished ground drill thereat. The cycle continues automatically until all the drills in the magazine are ground.

53 Claims, 11 Drawing Sheets

AUTOMATIC DRILL LOADER

BACKGROUND OF THE INVENTION

1. Field of the Invention

This invention pertains to workpiece handling, and more particularly to apparatus for loading workpieces into a machine tool.

2. Description of the Prior Art

Various equipment has been developed to automatically transport workpieces to a machine tool for processing. Such equipment varies widely to suit both the workpieces to be processed and the particular machine tools. A specialized application of workpiece handling and processing involves machines for grinding drills, end mills, taps, and similar cutting tools. For example, workpieces in the form of new drill blanks are inserted into tool holding chucks of drill grinding machines for having the drill cutting edges ground. After grinding, the drills are removed from the chucks.

In the past, it was common practice to manually load and unload drill grinding machines. However, productivity is increased considerably with the use of automatic mechanisms for loading and unloading the drills. Accordingly, many modern drill grinding machines include automatic loaders. For example, U.S. Pat. No. 4,821,463 describes a robot-like mechanism for storing, loading, and unloading drills. U.S. Pat. No. 3,711,997 shows a drill pointing machine with an automatic drill locator that includes a hopper-shuttle assembly. Other loading apparatus utilizes horizontal or vertically oriented carousels together with appropriate mechanisms for transferring the tools to and from the machine chuck.

For several reasons, the prior tool loading devices associated with drill grinding machines are somewhat deficient. One important drawback is that the prior drill loading devices occupy an undesirably large amount of space around the grinding machine. Many of the prior loaders are also undesirably complicated in their design and construction. In addition, the prior loaders are limited to handling drills of only one length on a particular setup and grinding operation. The prior loading and unloading mechanisms are also unable to handle multi-diameter drill shanks.

Consequently, further development of equipment for loading and unloading drill grinding machines is required.

SUMMARY OF THE INVENTION

In accordance with the present invention, a versatile automatic drill loader is provided that efficiently presents and removes different sized drills to a drill grinding machine. This is accomplished by apparatus that includes a drill-storing magazine having multiple adjustments and two sets of drill grippers that cycle in a unique combination of synchronous and independent motions to load and unload the drill grinding machine.

The automatic drill loader is designed to mount to the wheel guard and lid of several different models of commercially available drill grinding machines. The automatic drill loader is further designed to be retrofit onto existing machines and thereby upgrade the prior machines with the latest tool handling technology.

The automatic drill loader magazine includes a hopper having vertical front and back end plates. The front and back end plates lie in planes that are perpendicular to the axis of the machine workhead chuck.

That is, considering the axis of the machine workhead chuck to be the Z axis, the front and back end plates lie in respective X-Y planes, where X is defined as a horizontal axis and Y is defined as a vertical axis, with the X and Y axes being perpendicular to the Z axis. Drills in the form of new blanks or existing drills that need resharpening are stored in the hopper such that their longitudinal axes are parallel to the Z axis. The cutting ends of the drills are adjacent the hopper back end plate.

The automatic drill loader magazine is attached by a sturdy magazine housing to the machine wheel guard. A hopper back end plate is stationarily secured to the magazine housing. A support bracket is also mounted to the magazine housing. The support bracket and magazine housing support and guide a pair of horizontal rails that are movable in the Z directions. A front end bracket is connected to the rails. Accordingly, the spacing between the front end bracket and the stationary back end plate can be adjusted horizontally by sliding the rails in the Z directions.

The drills are supported within the hopper by front and back wear plates. The back wear plate is joined to the hopper back end plate to support the cutting ends of the drills. The front wear plate is joined to the hopper front end plate. The front wear plate supports the shanks of the drills. The hopper is able to accommodate drills of different lengths by adjusting the distance between the moveable front end bracket and the stationary back end plate. In addition, drills having length variations of up to two inches can be stored in the hopper for a particular distance between the front end bracket and the back end plate. The front end plate is capable of vertical adjustment relative to the back wear plate. With the cutting ends of the drills supported on the back wear plate, the front wear plate can be adjusted by means of the adjustable front end plate to support the shanks of drills having different diameter shanks and cutting ends.

The front and back wear plates are sloped in a manner that causes the drills in the hopper to roll toward the axis of the machine workhead chuck. To retain the drills within the hopper, gates are adjustably connected to each of the back and front end plates. The gates are vertically adjustable to create openings between their respective bottom edges and bottom walls of the front and back wear plates. The openings permit one drill at a time to roll out of the hopper and to a pickup station.

To remove a drill from the pickup station, the magazine further comprises a staging mechanism including a stage block that undergoes compound motions in an X-Y plane. The stage block is supported for reciprocation within a stage housing that is pivotally connected to the magazine housing. A first stage actuator of the staging mechanism causes reciprocation of the stage block relative to the stage housing. A second stage actuator pivots the stage housing relative to the magazine housing. The operation of the two stage actuators is coordinated to impart a compound motion to the stage block. The stage block moves in a path to position independently adjustable V-blocks secured thereto under a drill at the pickup station and lift the drill from the pickup station and transfer it to a nearby staging station.

From the staging station, the drill is conveyed to a timing station. For that purpose, one of the sets of drill grippers, referred to as the load gripper, grips the drill and lifts it from the staging station to the timing station.

The load gripper, together with the second set of grippers, called the unload gripper, are mounted through a single housing to the lid of the drill grinding machine. A single X-axis power slide built into the single housing supports and translates an X-axis carrier in the X directions. The X-axis carrier supports a pair of brackets to which are mounted respective fluid operated Z-axis power slides. The two Z-axis power slides support respective Z-axis carriers and reciprocate them independently in the Z directions. Built into the Z-axis carriers are respective Y-axis power slides. The Y-axis power slides support respective Y-axis carriers and reciprocate them independently in the Y directions. Thus, it is seen that actuating the X-axis power slide causes the two Z-axis power slides and the two Z-axis carriers, together with the two Y-axis power slides and the two Y-axis carriers, to traverse simultaneously as a unit in the X directions. On the other hand, the two Z-axis power slides on the X-axis carrier can be operated independently of each other to move the Z-axis carriers, together with their respective Y-axis power slides and Y-axis carriers, independently in the Z directions. The two Y-axis power slides are also independent of each other to move the respective Y-axis carriers in the Y directions independently of each other.

The load and unload grippers comprise generally similar drill gripping mechanisms. Each drill gripping mechanism is comprised of a long vertically extending gripper plate and a base slide attached to the gripper plate. The gripper plate and base slide define a vertically oriented channel. A pair of levers and a cam slide fit within the channel. Two pins held in the base slide and the gripper plate pass through the channel and through the first ends of respective levers such that the levers can pivot within the channel about their respective pins. A roller is mounted in each lever and rides in a corresponding angled slot in the cam slide. A gripper power actuator attached to the gripper plate reciprocates the cam slide. Such reciprocation causes the slots in the cam slide to act on the rollers of the levers in a manner that oscillates the levers about their respective pins. The angled slots are designed to enable the levers to pivot in opposite directions about their first ends so as to open and close their second ends. Jaws on the second ends of the levers are suitable for gripping and releasing a drill in response to closing and opening of the lever second ends.

With a drill at the staging station, the X-axis power slide moves the X-axis carrier, and thus the Y-axis and Z-axis carriers, until the longitudinal axis of the load gripper is in the same vertical plane as the longitudinal axis of the drill at the staging station. Then the Z-axis power slide of the load gripper acts to position the drill gripping mechanism of the load gripper directly over the drill at the staging station. The Y-axis power slide operates to lower the open jaws of the drill gripping mechanism over the drill. At that point, the jaws close over the drill at approximately its midpoint. Finally, the Y-axis power slide operates to raise the Y-axis carrier a predetermined amount to convey the drill to the timing station.

In the preferred embodiment, the timing station comprises a bushing holder sized to suit the drills that are to be ground during a particular operation. The bushing holder is installed in a timing station housing that may be fastened to the drill grinding machine lid or other suitable structure. Axially aligned with the bushing holder is a timing disk. The timing disk is mounted to the shaft of a rotary drive. The timing disk carries a pin. The pin extends axially from the timing disk, and the pin axis is radially displaced from the axis of the timing disk.

The timing station further comprises a pusher mechanism mounted to the magazine front end bracket. The pusher mechanism includes a shaft capable of combined rotary and linear motions, as well as an arm on the end of the shaft. A pusher power actuator normally operates to place the shaft and arm in a retracted configuration out of the way of the drill and the load gripper at the timing station.

The load gripper conveys the drill from the staging station to a pre-timing position between the timing station housing and the pusher mechanism, with the drill being in axial alignment with the bushing holder. The pusher mechanism power actuator operates to extend the shaft and simultaneously rotate the arm in a manner that enables the arm to contact the back end of the drill in the drill gripping mechanism. The load gripper relaxes its grip on the drill, and the shaft extends further to push the drill from the pre-timing position into the timing station bushing holder until the drill point abuts the timing disk.

With the drill point against the timing disk, the rotary drive rotates 360 degrees and stops at a particular angular orientation relative to the drill grinding machine. That motion assures that the pin enters a drill flute and rotates the drill to stop at a predetermined angular orientation in space. With the drill point both axially and rotationally at the desired location, the drill is said to be timed.

At that point, the load gripper regrips the drill. The Z-axis power slide operates the Z-axis carrier to pull the drill out of the timing station bushing holder. That accomplished, the X-axis and Y-axis power slides operate the X-axis and Y-axis carriers, respectively, to move the load gripper horizontally and vertically until the drill is axially aligned with the workhead chuck of the drill grinding machine. The Z-axis power slide operates to insert the drill into the workhead chuck. The Z-axis motion is carefully controlled by an adjustable positive stop. In that manner, the timed drill is presented to the grinding wheel of the drill grinding machine. The jaws of the load gripper open completely and the workhead chuck grips the drill. While the drill is being ground, the load gripper repeats the X, Y, and Z-direction motions to pick up another drill at the staging station.

Meanwhile, simultaneously with the actions of the load gripper, the unload gripper is undergoing multidirectional motions that are necessary to remove a finished ground drill from the drill grinding machine workhead and to carry the ground drill to a suitable storage receptacle. Specifically, as the load gripper is transporting a fresh drill in an X direction into position axially aligned with the workhead chuck, the unload gripper is simultaneously carrying a finished ground drill the same distance in the same X direction to place that drill at the storage receptacle. The unload gripper releases its finished drill while the load gripper is inserting and releasing its fresh drill in the machine workhead. Then, as the load gripper returns in the X direction to vertically align its drill gripping mechanism with another drill at the staging station, the unload gripper simultaneously moves the same amount in the same X direction to be vertically aligned with the drill being ground. Subsequent Y-direction and Z-direction motions position the jaws of the load and unload grippers over the drills at the staging station and workhead chuck, respectively. In that manner, the load and unload grippers cooperate on a continuous basis to present unground drills to the machine workhead and to remove ground drills from the workhead.

To minimize the possibility of mechanism jams during operation, the various power actuators of the automatic drill loader of the present invention are preferably pneumatic cylinders operating on relatively low pressures. As a related consideration, all of the various motions of the load and unload grippers are controlled by limit switches or optical sensors. The limit switches and optical sensors are located to indicate the important end positions of the various carrier movements. In that manner, reliable and efficient operation of the automatic drill loader is assured.

After a run of drills having a predetermined diameter has been completed, the automatic drill loader is easily and quickly readjusted for a run of new drills of a different diameter. Some of the adjustments include the V-blocks of the magazine staging mechanism and the opening size set by the magazine gates. The bushings for the timing station and workhead chuck must be changed to suit the new drill diameter. In addition, the magazine hopper front end bracket is adjusted if the lengths of the new drills are different than the lengths of the previous drills. The wear plate on the magazine hopper front end plate is adjusted vertically if the new drills have a stepped shank diameter different than the drills in the prior run. All the adjustments are accomplished with minimum effort and time to thereby minimize downtime for setup changes.

Other advantages, benefits, and features of the invention will become apparent to those skilled in the art upon reading the detailed description of the invention.

DETAILED DESCRIPTION OF THE PREFERRED EMBODIMENT

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

GENERAL

Figure 1:
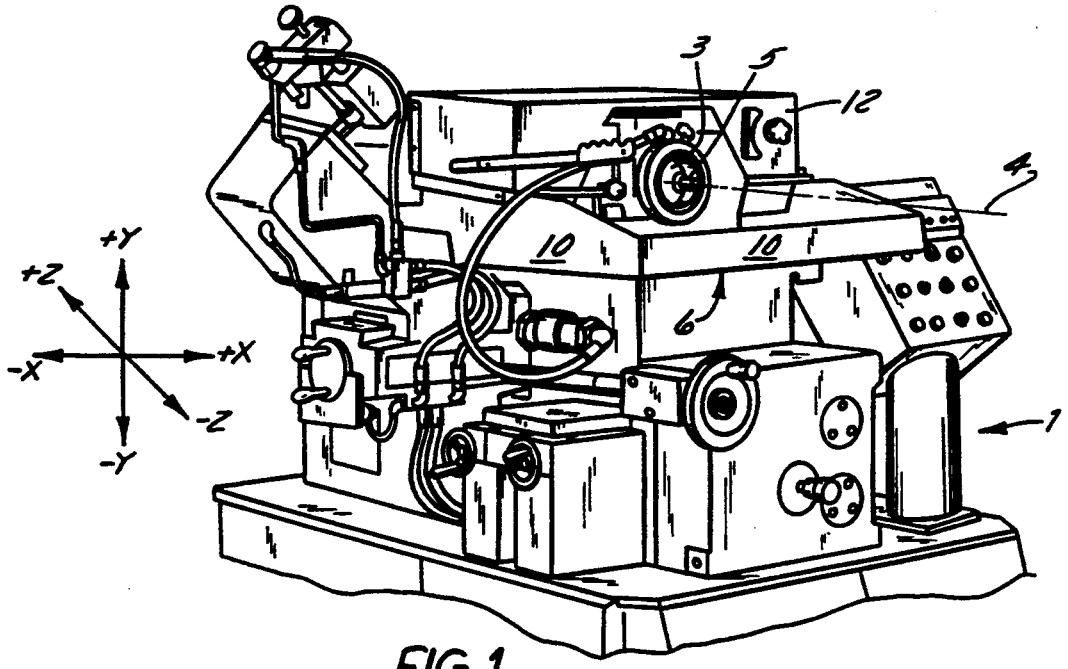
FIG. 1 is a perspective view of a portion of a typical drill grinding machine that advantageously includes the automatic drill loader of the present invention.

Referring to FIG. 1, a drill grinding machine 1 is illustrated that advantageously utilizes the automatic drill loader of the present invention. The particular drill grinding machine 1 shown is merely representative of a wide variety of equipment that is used to manufacture and maintain cutting tools such as end mills and taps, as well as drills.

The drill grinding machine 1 includes a workhead 3 having a generally horizontal axis 4. A typical drill 5 is gripped in a chuck of the workhead 3. The workhead undergoes rather complicated three dimensional cyclical motions in space to impart corresponding motions to the drill 5. The drill point is pressed against a rotating grinding wheel, not shown, as the drill undergoes its cyclical motions. The result is that a proper point is ground on the drill. Thereafter, the finished drill is removed from the workhead chuck, a fresh drill is presented to the workhead, and the process is repeated. An exemplary machine for grinding several types of points on drills is described in U.S. Patent Application Ser. No. 513,080.

The drill grinding machine 1 typically includes a wheel guard 6. The wheel guard 6 is shown in the form of a rather heavy pan having a floor 8 and upstanding sides 10. Also see FIG. 5. A heavy lid 12 is pivotally connected to the wheel guard near the back of the machine. When the lid 12 is closed, as is shown in FIG. 1, the workhead 3, the grinding wheel, and the components for cyclically driving the workhead are covered and inaccessible to nearby persons. On the other hand, by pivoting the lid 12 open, a person can gain access to the various internal mechanisms of the machine.

For convenience, a coordinate system will be used in describing the structure and operation of the invention. Horizontal directions perpendicular to the longitudinal axis 4 of the workhead 3 will be considered to be X directions. Vertical directions perpendicular to the longitudinal axis of the workhead are considered to be Y directions. Directions parallel to the longitudinal axis of the workhead are considered to be Z directions.

In addition, as viewed with respect to FIG. 1, the horizontal direction toward the right will be called the +X direction, and the horizontal direction toward the left will be the −X direction. The upward vertical direction will be the +Y direction, and the downward vertical direction will be the −Y direction. The horizontal direction toward the back of the drill grinding machine 1 will be the +Z direction, and the horizontal direction toward the front of the drill grinding machine will be the −Z direction.

AUTOMATIC DRILL LOADER

In accordance with the present invention, drills 5 are automatically presented to and removed from the workhead 3 of the drill grinding machine 1 by an automatic drill loader 7. Looking especially at FIGS. 2, 3, and 7, the automatic drill loader 7 is comprised of four major components: a magazine 9, a timing station 11, and a pair of drill grippers 13 and 15. The magazine 9 is mounted to the wheel guard 6 of the drill grinding machine 1. The timing station 11 and the drill grippers 13 and 15 are mounted to the machine lid 12.

A quantity of drills 5A are stored in a hopper 17 of the magazine 9 with the longitudinal axes of the drills lying in the Z direction. The drills 5A are allowed to roll one at a time from the hopper 17 to a pickup station 19. A staging mechanism 27 of the magazine 9 moves with compound motion to transfer a drill 5A from the pickup station 19 to a nearby staging station 23.

The drill gripper 13, known as the load gripper, grips the drill 5F at the staging station 23 and conveys it to the timing station 11. At the timing station, the drill 5G is properly located in space, both axially and angularly. Then the load gripper 13 transports the timed drill 5G to the workhead 3 for being gripped therein and ground. While the drill 5 is being ground, the load gripper returns to the staging station 23 to grip a fresh drill 5F waiting there and to convey it to the timing station. Simultaneously, the drill gripper 15, known as the unload gripper, moves to the workhead chuck to remove the finished drill 5H. The unload gripper carries the finished drill 5H to a storage receptacle 25 at the same time the load gripper brings a fresh drill 5G from the timing station to the workhead chuck. The load and unload cycle is repeated in conjunction with the drill timing and grinding processes until all the drills 5A stored in the magazine hopper 17 have been ground.

MAGAZINE HOPPER

The magazine 9 of the automatic drill loader 7 is comprised of the hopper 17, the pickup station 19, and the staging mechanism 27. The magazine is attached to the wheel guard 6 of the drill grinding machine 1 by means of a magazine housing 29. The magazine housing 29 has spaced apart front and back plates 31 and 33, respectively. Also see FIG. 4. The housing front and back plates 31 and 33, respectively, are connected by a bottom bar 35 and by a side bar 37. The magazine housing bottom bar 35 attaches to the underside of the wheel guard through a spacer 39. The side bar 37 of the magazine housing 29 attaches to the wheel guard through a similar spacer 41.

The front plate 31 of the magazine housing 29 has an upper surface 43 that is indented to receive right and left rail guides 45 and 47, respectively. To the back plate 33 of the magazine housing 29 is secured a back end plate 49 of the hopper 17. The hopper back end plate 49 is sandwiched between the magazine housing back plate 33 and a support bracket 51. The support bracket 51 is generally L-shaped and has an upper surface 53 that is machined with right and left grooves 55 and 57, respectively, FIG. 6. The right and left grooves 55 and 57, respectively, of the L-shaped support bracket 51 are aligned in the Z directions with the right and left rail guides 45 and 47, respectively, of the magazine housing front plate 31.

The right rail guide 45 in the magazine housing front plate 31 and the right groove 55 in the L-shaped bracket 51 support and guide a right rail 59 for sliding in the Z directions. The left rail guide 47 in the magazine housing front plate 31 and the left groove 57 in the L-shaped bracket 51 support and guide a left rail 61 for sliding in the Z directions. The slidable rails 59 and 61 are tied together through a front end bracket 73 and conventional fasteners, not shown.

A U-shaped clamp block 63 fits over the rails 59 and 61 and is fastened to the L-shaped bracket 51 to slidingly capture the rails. To clamp the rails 59 and 61 at desired locations along the grooves 55 and 57 and the rail guides 45 and 47, and to simultaneously fix the location of the front end bracket 73, a pair of generally similar clamps 65 are used in connection with the clamp block 63. Each clamp 65 has a threaded shaft 67, a knob 69, and a heel 71. The heels 71 of the clamp 65 are contactable with associated rails 59 and 61. By manually turning the knob 69, the rails are selectively clamped against sliding along the guides 45 and 47 and the grooves 55 and 57. By sliding the rails along the guides 45 and 47 and the grooves 55 and 57, the spacing between the hopper back end plate 49 and the front end bracket 73 is changeable.

Figure 2:
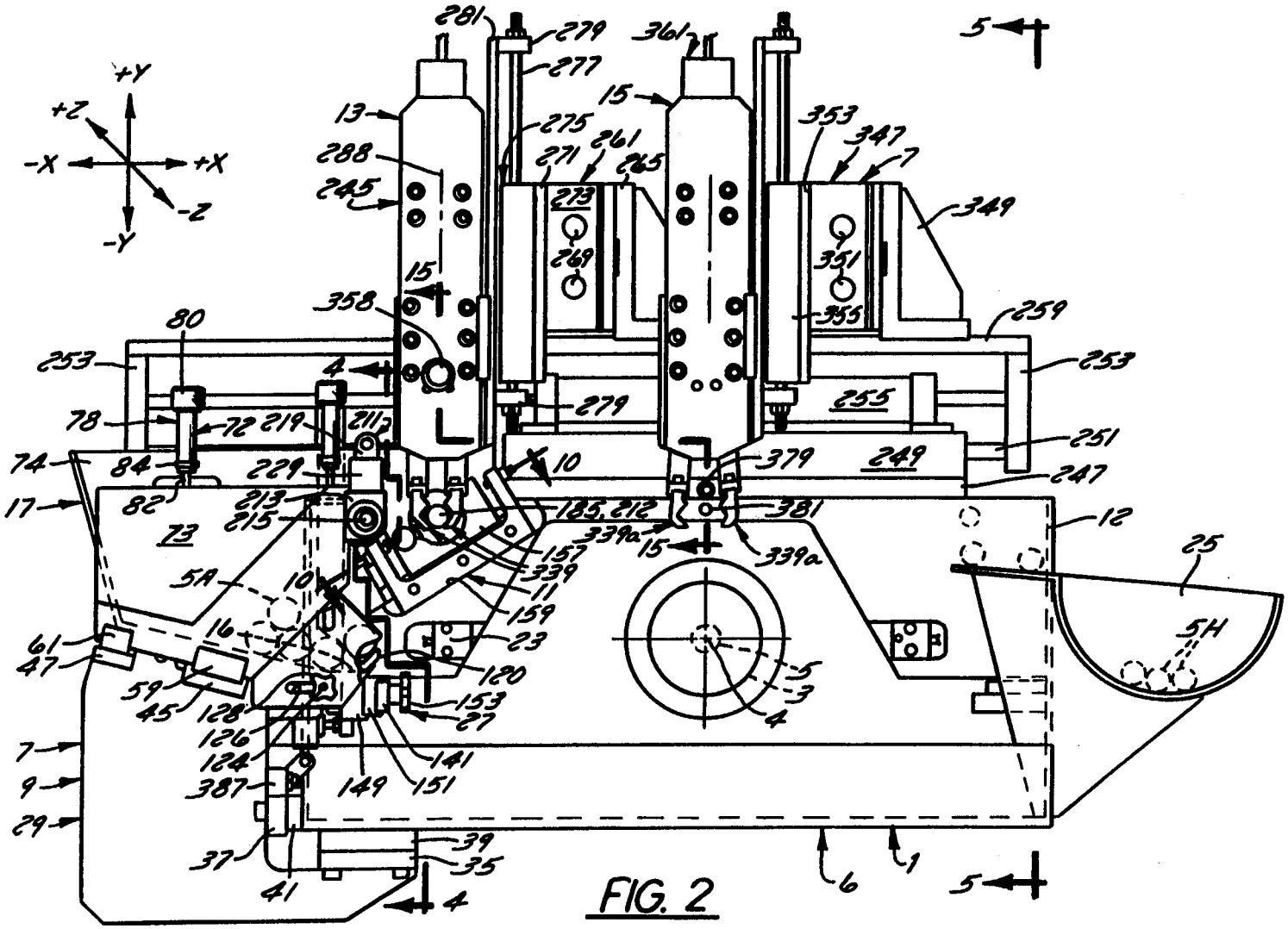
FIG. 2 is a partially broken front view of the automatic drill loader of the present invention mounted to the drill grinding machine of FIG. 1.
Figure 3:
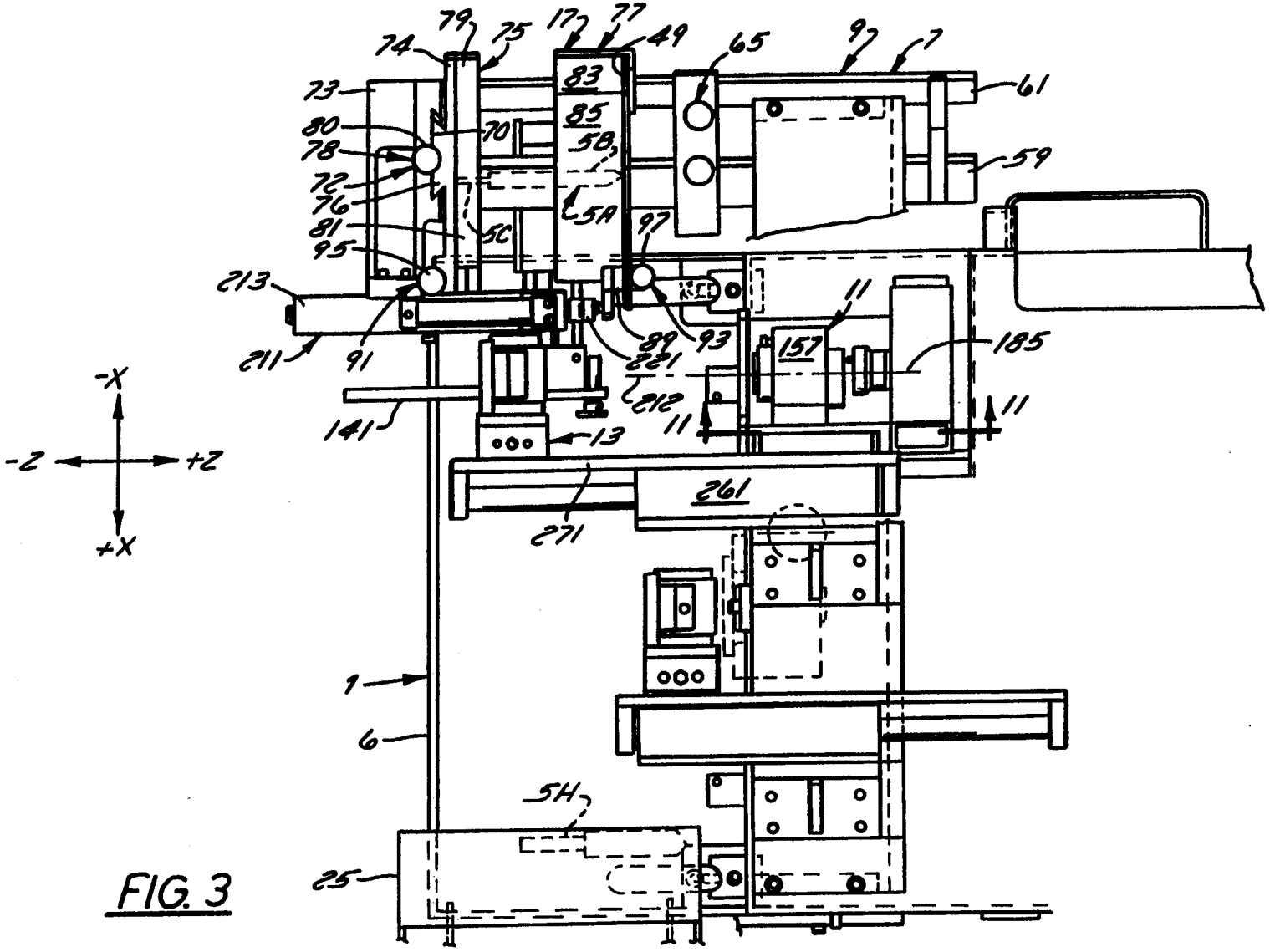
FIG. 3 is a top view of the automatic drill loader mounted to the drill grinding machine.
Figure 4:
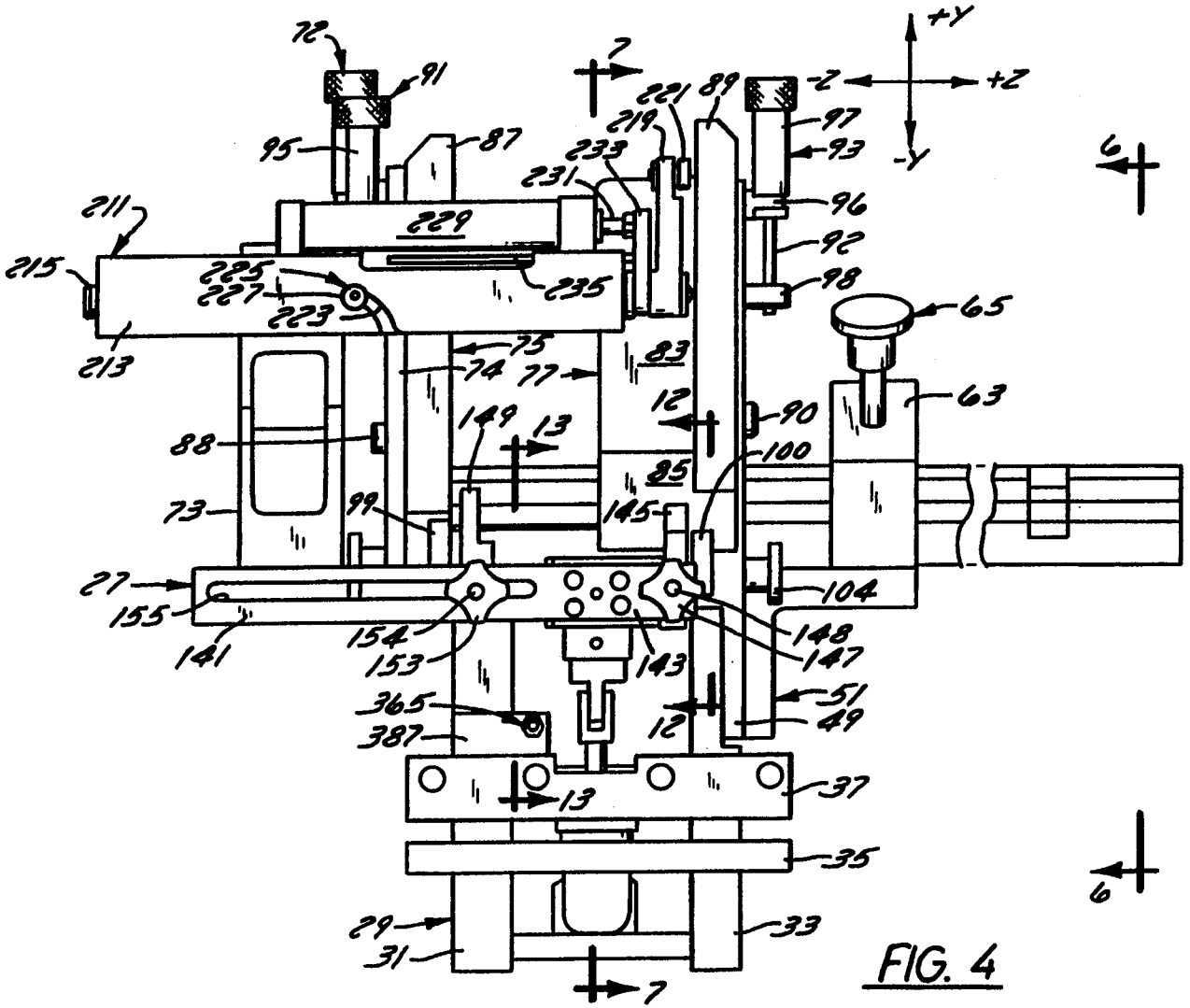
FIG. 4 is a view taken along lines 4—4 of FIG. 2.

Looking especially at FIGS. 2, 3, and 4, the front end bracket 73 adjustably supports a front end plate 74 of the magazine hopper 17. The front end plate 74 is adjustable in the vertical directions by means of an adjustment mechanism 72. The adjustment mechanism 72 includes a dovetail slide 76 formed on the front end plate 74, a matching groove 70 in the front end bracket 73, and an adjustment screw 78. The adjustment screw 78 has a knurled knob 80 and a shank 82 threadably received in the front end bracket 73. A collar 84 axially retains the adjustment screw 78 to the front end plate 74. By rotating the shank 82 through the knob 80, the front end plate 74 is vertically movable relative to the front end bracket 73 and relative to the back end plate 49.

To store the drills 5A in the magazine hopper 17, a front wear plate 75 is joined to the front end plate 74, and a back wear plate 77 is joined to the back end plate 49. The front wear plate 75 is fabricated with a sloped back wall 79 and a sloped bottom wall 81. The back wear plate 77 is fabricated with a back wall 83 that is generally parallel to the front wear plate back wall 79. The back wear plate 77 also has a bottom wall 85 that is generally parallel to the bottom wall 81 of the front wear plate 75. The drills are stored in the hopper 17 with their cutting ends 5B adjacent the back end plate and resting on the back wear plate, and with their shank ends 5C resting on the front wear plate. It is thus seen that sliding the rails 59 and 61 along the guides 45 and 47 and the grooves 55 and 57 changes the spacing between the magazine hopper front end plate 74 and back end plate 49 to suit drills of different lengths that are to be stored in the hopper.

Adjustment of the adjusting screw 78 provides vertical adjustment between the bottom wall 81 of the front wear plate 75 and the bottom wall 85 of the back wear plate 77. In that manner, the front wear plate 75 can support the shanks 5C of drills 5A that have shanks that are smaller than the cutting ends 5B. For drills having a single diameter, the front end plate 74 is adjusted relative to the back end plate 49 such that the front and back wear plates 75 and 77, respectively, are coplanar.

The drills 5A stored in the magazine hopper 17 tend to roll by gravity down the front and back wear plates 75 and 77, respectively. To prevent the drills from rolling out of the hopper without control, a pair of gates are included in the magazine 9. A front gate 87 is adjustably connected to the front end plate 74, and a back gate 89 is adjustably connected to the back end plate 49. The gate 87 is independently adjustable relative to the gate 89 in order to enable drills having stepped shanks 5C to pass with control under the gates.

Figure 6:
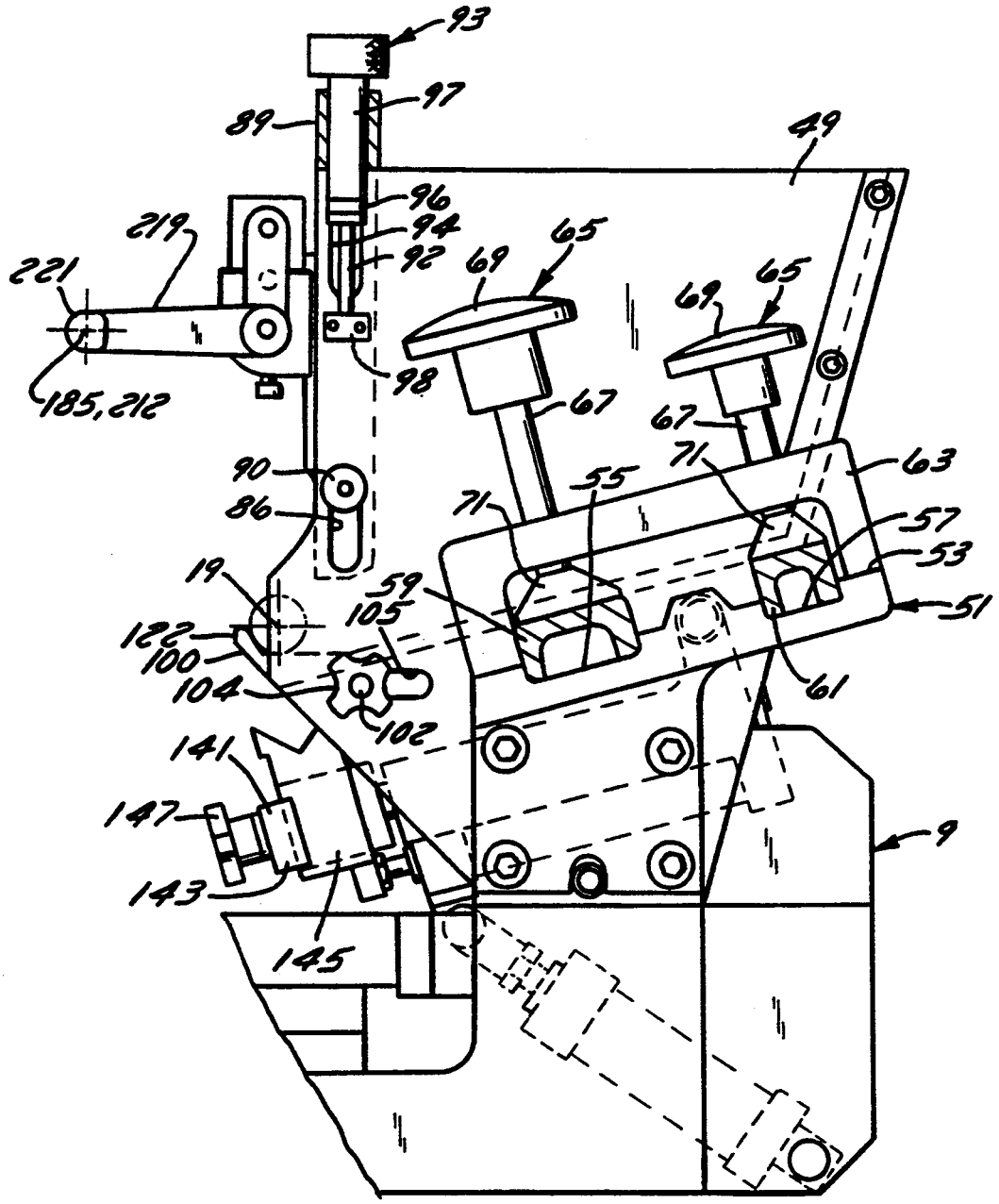
FIG. 6 is a view taken along lines 6—6 of FIG. 4.

Adjustment of the front and back gates 87 and 89 relative to the front and back end plates 74 and 49 is provided by respective adjustment mechanisms 91 and 93. Also see FIG. 6. The adjustment mechanisms 91 and 93 are generally similar to the adjustment mechanism 72 between the front end bracket 73 and the front end plate 74 described previously. Considering the back adjustment mechanism 93, a screw 97 has a threaded end 92 that mates with a block 98 fixed to the back end plate 49. The screw 97 is captured in a collar 96 that is attached to the gate 89 and that passes through a vertical slot 94 in the back end plate 49. By turning the adjusting screws 95 and 97 of the respective adjustment mechanisms 91 and 93, the gates can be raised and lowered relative to the bottom walls 81 and 85 of the front and back wear plates 75 and 77, respectively. Locking screws 88 and 90 that pass through vertical slots in the front and back end plates retain and guide the gates 87 and 89, respectively. FIG. 6 shows the slot 86 in the back end plate 49 for the locking screw 90.

MAGAZINE PICKUP STATION

A drill 5A rolls by gravity under the hopper gates 87 and 89 and to the magazine pickup station 19. Turning to FIGS. 2, 4, 6, 7, and 12, the pickup station 19 is defined by independently adjustable front and back stops 99 and 100, respectively. The back stop 100 is horizontally slidable within a pocket 103 machined in the back end plate 49. A stud 102 passes through a horizontal slot 105 in the back end plate and terminates in a knob 104. Similarly, the front stop 99 is horizontally slidable in a pocket in the front end plate 74. A stud 124 passes through a horizontal slot 126 in the front end plate and has a knob 128. By loosening and tightening the knobs 104 and 128, the stops 100 and 99, respectively, can be slid horizontally independent of each other in X directions.

The stops 99 and 100 have respective upper surfaces 116 and 118. The stops 99 and 100 are located within the front and back end plates 74 and 49 such that their upper surfaces 116 and 118 intersect the bottom walls 81 and 85 of the front and back wear plates 75 and 77, respectively, and form horizontal extensions thereof. Bumpers 120 and 122 on the ends of the stops 99 and 100, respectively, retain the drill 5E against rolling off the stops.

It will be appreciated that the horizontal locations of the axial centerlines of drills 5E at the pickup station 19 would vary with the drill diameters if the bumpers 120 and 122 of the stops 99 and 100, respectively were to remain at fixed locations. However, by means of the knobs 104 and 128, the stops 99 and 100, respectively, are adjustable in the X directions no accommodate different size drills. Adjustment of the stops assures that the drill is located external of the gates 87 and 89. The front stop 100 is adjustable independently of the back stop so as to enable drills with stepped shanks to be properly retained at the pickup station. The vertical location of the drill centerlines at the pickup station is not critical.

MAGAZINE STAGING MECHANISM

Figure 13:
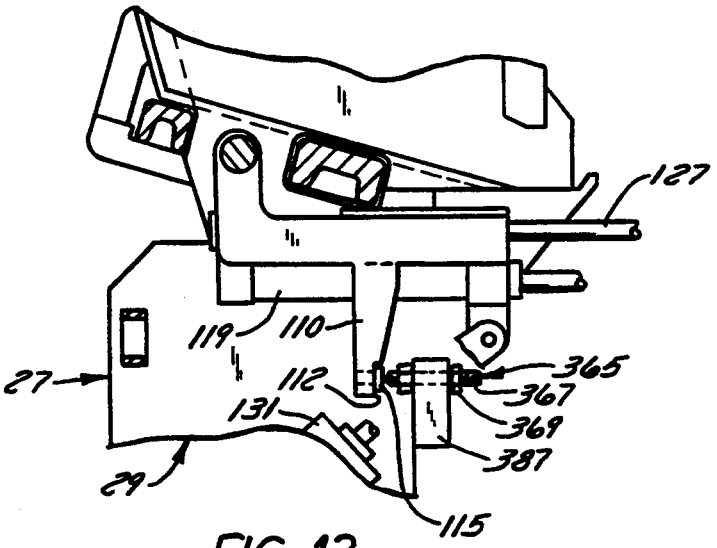
FIG. 13 is a partial cross sectional view taken along lines 13—13 of FIG. 4.

To transfer a drill 5E from the pickup station 19 to the staging station 23, the automatic drill loader 7 includes the staging mechanism 27. In the preferred embodiment, the staging mechanism 27 comprises a generally L-shaped stage housing 101. The stage housing 101 is located between the front and back plates 31 and 33, respectively, of the magazine housing 29. The stage housing is pivotally connected to the magazine housing front and back plates by a pin 107 passing through spaced upstanding legs 109 of the stage housing. A finger 110 having a flat 112 depends from the stage housing 101. Also see FIG. 13. A button 115 is screwed into the stage housing finger 110 and seats against the flat 112.

Pressed into a central block 114 of the stage housing 101 are a pair of horizontally oriented bushings, not shown. The bushings slidably support respective horizontal rods 113. One end of each rod 113 is pressed into a stage block 117.

The stage block 117 and the rods 113 reciprocate in the X directions under the influence of a first stage actuator 119. Preferably, the first stage actuator 119 is an air cylinder that operates under relatively low pressure. The first stage actuator 119 is secured to the undersurface of the stage housing central block 114. The piston rod 121 of the first stage actuator 119 is attached by means of a small block 123 to the undersurface 125 of the stage block 117. Accordingly, actuation of the first stage actuator 119 reciprocates the stage block 117 and the rods 113 in the X directions. To provide an end stop for the stroke of the first stage actuator 119, a long stud 127 is threaded at one end into the stage block 117. The stud 127 slidingly passes through the stage housing central block 114. A pair of nuts 129 threaded onto the second end of the stud 127 adjustably set the end stop of the stage block motion in the +X direction relative to the stage housing 101.

To pivot the stage housing 101 about the pin 107, a second stage actuator 131 in the form of a low pressure air cylinder is employed. The second stage actuator 131 has one end 133 thereof pivotally connected between the front and back plates 31 and 33, respectively, of the magazine housing 29. The piston rod 135 of the second stage actuator 131 is pivotally connected through a clevis 137 to an eye bracket 139. The eye bracket 139 is attached to the underside of the first stage actuator 119. Actuation of the second stage actuator 131 causes the stage housing 101 and the stage block 117 to pivot in an X-Y plane. By simultaneous actuation of the first and second stage actuators 119 and 131, respectively, the stage block 117 undergoes a compound motion in the X-Y plane.

Fastened to the vertical face of the stage block 117 opposite the rods 113 and stud 127 is an elongated horizontal carrier 141. Near the back end 143 of the carrier 141 is mounted a back V block 145. The back V block 145 has a vertically extending slot (not shown) and a sharp inner edge 146. A back knob 147 has a threaded shank 148 that extends through a hole in the carrier 141 and through the slot in the back V block 145. A nut is threaded on the knob shank 148 and is captured in a step along the back V block slot. By turning the back knob 147 to sequentially loosen and tighten the nut on the knob shank 148, the position of the back V block can be adjusted vertically relative to the carrier 141.

A front V block 149 is also mounted to the carrier 141, FIGS. 2 and 4. The front V block 149 is generally similar to the back V block 145, having a sharp inner edge. However, a slider 151 is interposed between the carrier 141 and the front V block 149. The slider 151 is stepped to mate with and to slide along the carrier 141 in the Z directions. The slider 151 is also stepped to mate with and enable the front V block 149 to slide vertically within the slider. A front knob 153 has a threaded shank 154 that passes through a long horizontal slot 155 in the carrier 141, through a hole in the slider 151, and through a vertically extending slot (not shown) in the front V block 149. A nut is captured within a step in the front V block. The nut is threaded onto the shank 154 of the front knob 153. By turning the front knob 153 to loosen and tighten the nut on the front knob shank 154, the front V block 149 is adjustable in both the Y and Z directions independently of the adjustment of the back V block 145.

Figure 7:
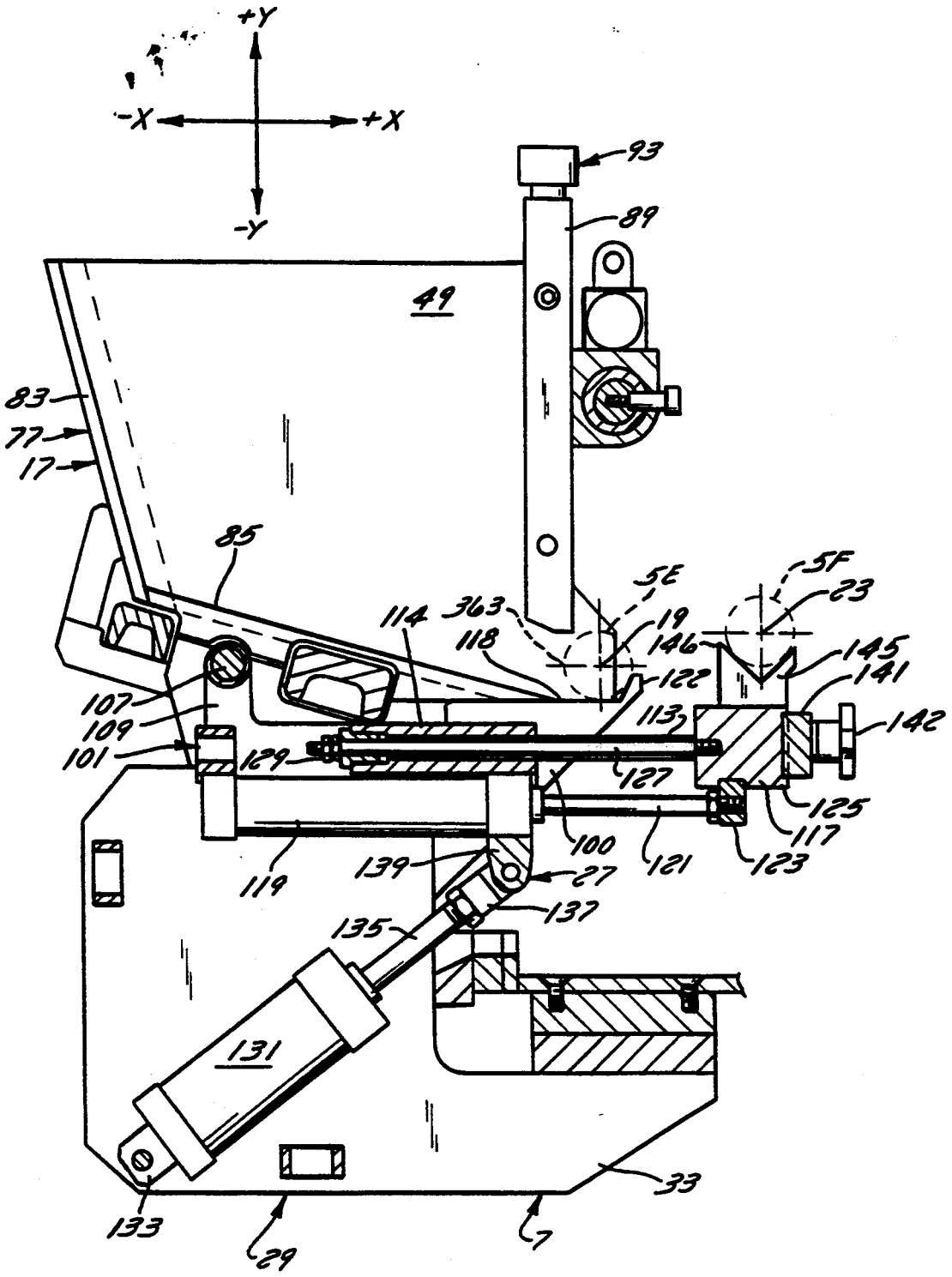
FIG. 7 is a view taken along lines 7—7 of FIG. 4.

Operation of the first and second stage actuators 119 and 131, respectively, causes the transfer of a drill 5E from the magazine pickup station 19 to the staging station 23, FIG. 7. Phantom lines 5F represent a drill at the staging station. Specifically, the first and second stage actuators cooperate to position the back and front V blocks 145 and 149, respectively, under the drill 5E resting on the surfaces 116 and 118 of the front and back stops 99 and 100, respectively. Then the second stage actuator 131 operates to cause the V blocks to rise under the drill, cradle it, and lift it generally vertically off the stops. Finally, the first stage actuator 119 operates to move the drill generally horizontally in a +X direction to the staging station. The adjustments possible to the back and front V blocks by means of the back and front knobs 147 and 153, respectively, enable the V blocks to cradle both different length drills and drills having stepped shanks. A major advantage of the design of the magazine hopper 17, pickup station 19, and staging mechanism 27 is that drills having up to two inch variations in their lengths can be accommodated for a particular setup distance between the hopper front and back end plates 74 and 49, respectively.

It will be appreciated that the location of the longitudinal axis of a drill 5E resting on the stop surfaces 116 and 118 and against the corresponding bumpers 120 and 122 varies with the diameter of the drill. The bumpers 120 and 122 locate the drill surface 363 that is farthest from the machine workhead axis 4 to be slightly to the right, as shown in FIG. 7, of the gates 87 and 89. The independent adjustability of the stops 99 and 100 enables drills having stepped shanks to be located at the pickup station.

TIMING STATION

From the staging station 23, the drill 5F is conveyed by the load gripper 13 to the timing station 11. See FIGS. 2, 3, 10, 11, and 14. At the timing station, the drill, represented by phantom lines 5G, is oriented in space in the Z directions and in an angular direction about the drill longitudinal axis. For that purpose, the timing station includes a timing housing 157 that fastens to a pad 158. The pad 158 is on an angled section 159 of the drill grinding machine lid 12. The timing housing 157 has a bore that defines a timing station axis 185. The timing station axis 185 is parallel to the axis 4 of the drill grinding machine workhead 3. The timing housing bore interchangeably receives a number of bushing holders typically represented at reference numerals 161, 163, and 165. The bushing holders 161, 163, and 165 have identical outer diameters, but they have different inner diameters. Each bushing holder 161, 163, and 165 interchangeably receives a number of bushings typically represented at reference numerals 167, 169, and 171. The bushings 167, 169, and 171 are removably held in place in their respective bushing holders by set screws 173.

The bushings 167, 169, or 171 for each associated bushing holder 161, 163, and 165 have constant outer diameters but variable inner diameters. The inner diameter of each bushing 167, 169, 171 is sized to accept a certain drill size. Drills of greater or lesser diameter than can be accommodated by the bushings of a particular bushing holder 161, 163, 165 require that a different bushing holder be used.

The bushing holders 161, 163, 165 are manufactured with identical flanges 175. An arcuate cutout 177 is formed in each flange 175 for the full length thereof. A step 179 is formed in the flange adjacent the cutout 177. A locking screw 181 is threaded into the timing housing 157. A relatively large diameter head 183 on the locking screw 181 overlaps the housing step 179. By rotating the bushing holder about the timing station axis 185 with the locking screw 181 loosened until the cutout 177 coincides with the locking screw head 183, the bushing holder can be removed from the timing housing 157 and a different bushing holder can be inserted into the timing housing. Then the bushing holder is rotated such that the step 179 underlies the locking screw head 183. Tightening the locking screw firmly holds the bushing holder in place.

The timing station 11 also includes a timing device 186. In the illustrated construction, the timing device 186 is comprised of a rotary drive 187 fastened to the plate 158 of the machine lid 12. The rotary drive 187 has an output shaft 189 with a shoulder 191. The shaft 189 is concentric with the timing station axis 185. An annular disk housing 193 is secured to the shaft shoulder 191. The disk housing 193 has external threads 195 that mate with internal threads of a collar 197. Sandwiched between a counterbore 199 of the disk housing 193 and a shoulder 201 of the collar 197 is one of a series of timing disks 203, 204, 206. Like the bushing holders 161, 163, 165 and the bushings 167, 169, 171, the timing disks 203, 204, 206 are designed to suit different ranges of drill diameters. Inserted into each timing disk 203, 204, 206 parallel and eccentric to the timing station axis 185 is a pin 205. A set screw 207 holds the pin 205 in place in the timing disk. Also pressed into the timing disk concentric with the timing station axis 185 is a hardened stop 209. The dimensions of the pin 205 and the hardened stop 209 vary with the particular timing disk 203, 204, 206. By energizing the rotary drive 187, the disk housing 193, collar 197, timing disk, and pin 205 rotate as a unit about the timing station axis 185.

Also part of the timing station 11 is a pusher mechanism 211, as is best shown in FIGS. 2–7. The pusher mechanism 211 is spaced in the −Z direction from the timing housing 157. Consequently, there is a portion 212 of the timing station axis 185 that lies in the space between the timing housing and the pusher mechanism. The pusher mechanism 211 is comprised of an elongated pusher block 213 that is mounted to the front bracket 73 of the magazine 9. The pusher bracket 213 slidingly supports a pusher shaft 215 through a pair of conventional ball bearing bushings, not illustrated in the drawings. To one end of the pusher shaft 215 is attached one end of an arm 219. The second end of the arm 219 is provided with a pusher button 221. The pusher block 213 is manufactured with a partial generally helical groove 223. A shoulder screw 225 is threaded into the pusher shaft 215 with the head 227 of the shoulder screw extending through the pusher block groove 223.

A low pressure air cylinder acting as a pusher actuator 229 is mounted to the top of the pusher block 213 and parallel to the pusher shaft 215. One end of a yoke 233 is connected to the piston rod 231 of the pusher actuator 229. The other end of the yoke 233 slidingly receives the pusher shaft 215 adjacent the arm 219. A guide rod 235 is threaded into the yoke 233 parallel to the pusher shaft 215. The guide rod 235 is slidable within the pusher block 213.

Actuation of the pusher actuator 229 causes reciprocation of the pusher shaft 215 and the arm 219 in the Z directions. Because of the helical groove 223 and the shoulder screw 225, reciprocation of the pusher shaft 215 causes simultaneous rotation of the pusher shaft and the arm 219. The guide rod 235 and the sliding fit between the yoke 233 and the pusher shaft 215 eliminate any rotational forces on the pusher actuator piston rod 231 during operation of the pusher mechanism 211. The groove 223 is so designed that the arm 219 is in a vertical upright attitude when the pusher shaft 215 is fully retracted, as is shown in FIGS. 2–5 and 7. The arm 219 is in a generally horizontal attitude, FIG. 6, when the pusher rod 215 is in the fully extended position. When the pusher shaft 215 is in the fully extended position and the arm 219 is in the generally horizontal attitude, the axial centerline of the pusher button 221 is generally coaxial with the timing station axis 185 and the portion 212 thereof that lies outside of the timing housing 157.

To sense when a drill 5G is inserted into the timing housing 157, pairs of fiber optic switches 237 and 239 are utilized. The fiber optic switches 237 and 239 are mounted by means of respective brackets 241 and 243 to the wheel guard pad 158 on opposite sides of the timing station housing 157. Both fiber optic switches are installed such that their light beams pass through the timing station axis 185.

LOAD GRIPPER

Looking especially at FIGS. 2, 3, 5, and 7, the load gripper 13 is used to transport a drill 5F from the staging station 23 to the timing station 11, and from the timing station to the machine workhead 3. For that purpose, the load gripper is capable of moving in the X, Y, and Z directions. In addition, the load gripper 13 includes a drill gripping mechanism 245.

The lid 12 of the drill grinding machine 1 is fabricated with a horizontally extending plate 247. To the top of the lid plate 247 is fastened an elongated casing 249. The casing 249 slidingly supports two long shafts 251 capable of X-direction reciprocation. Upstanding plates 253 are fastened to the opposite ends of the shafts 251. A double ended X-axis power slide 255, such as a low pressure pneumatic cylinder, is mounted to the top of the casing 249. The piston rods 257 of the X-axis power slide 255 are secured to the associated plates 253. An X-axis carrier 259 extends between and is joined to the plates 253. Actuation of the X-axis power slide 255 causes reciprocation of the X-axis carrier 259 in the X directions.

Supported on the X-axis carrier 259 is the load gripper Z-axis power slide 261. Support for the Z-axis power slide 261 may be by means of an angle plate 265. The Z-axis power slide 261 includes a pair of piston rods 269 that extend in the Z directions and that are reciprocable in the Z directions when the Z-axis power slide is actuated. A long Z-axis carrier 271 is supported by the piston rods 269 through a pair of plates 273 joined to the opposite ends of the piston rods 269. Actuation of the Z-axis power slide 261 thus causes reciprocation of the Z-axis carrier 271 in the Z directions.

Attached to the Z-axis carrier 271 is a vertically oriented Y-axis power slide 275. The Y-axis power slide 275 has a pair of piston rods 277, to the opposite ends of which are connected plates 279. A Y-axis carrier 281 extends between and is fastened to the plates 279. Actuation of the Y-axis power slide 275 causes the Y-axis carrier 281 to reciprocate in vertical directions.

To keep the weight and inertia of the load gripper 13 to a minimum, most of its components are made from aluminum.

DRILL GRIPPING MECHANISM

Figure 9:
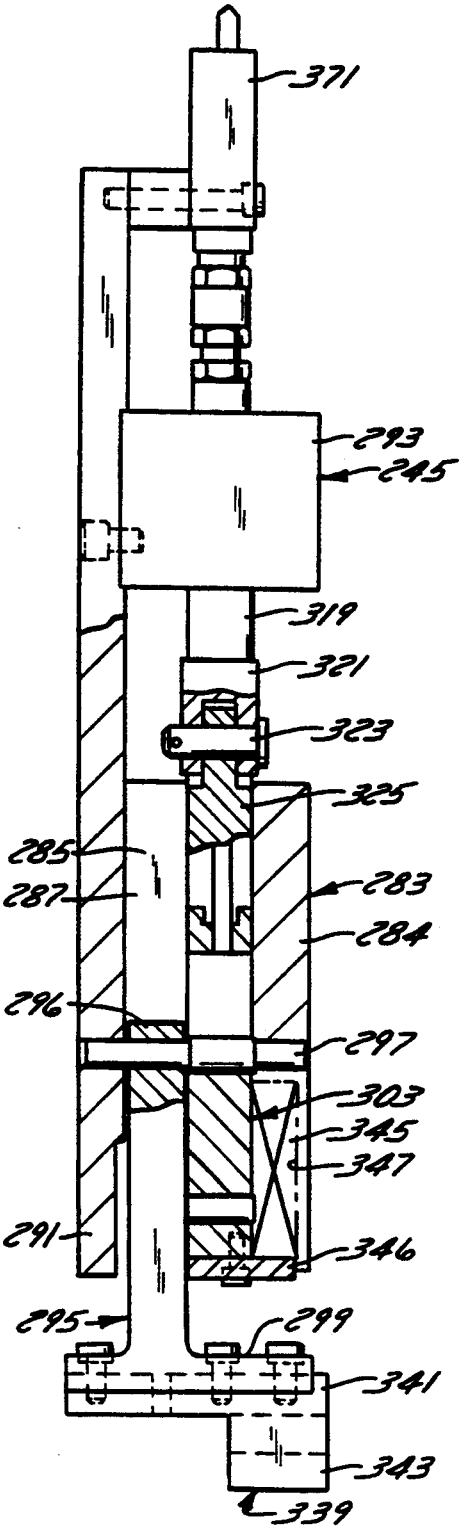
FIG. 9 is a cross sectional view taken along lines 9—9 of FIG. 8.
Figure 8:
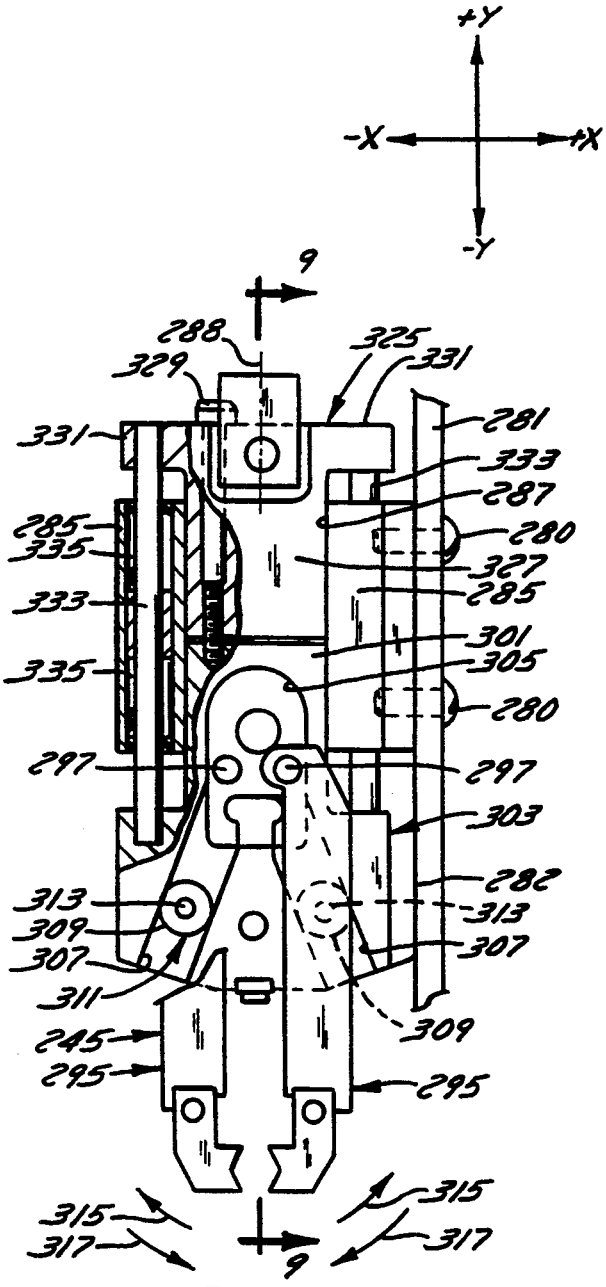
FIG. 8 is a partially broken front view of the drill gripping mechanism of the present invention.
Figure 11:
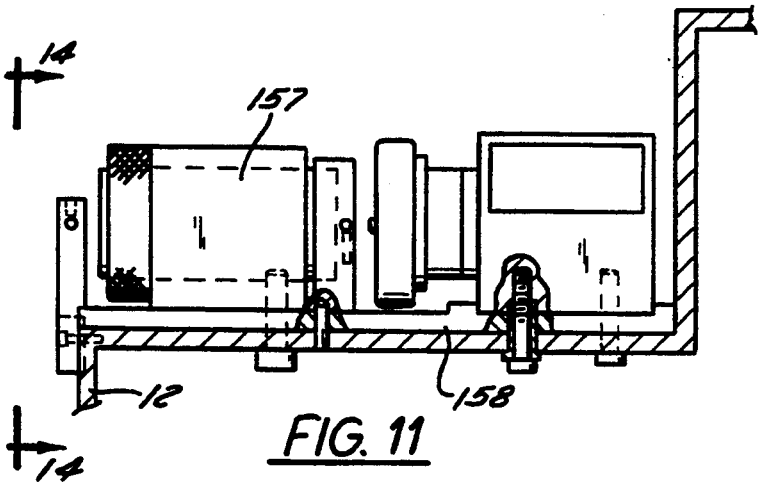
FIG. 11 is a partially broken view taken along lines 11—11 of FIG. 3.
Figure 10:
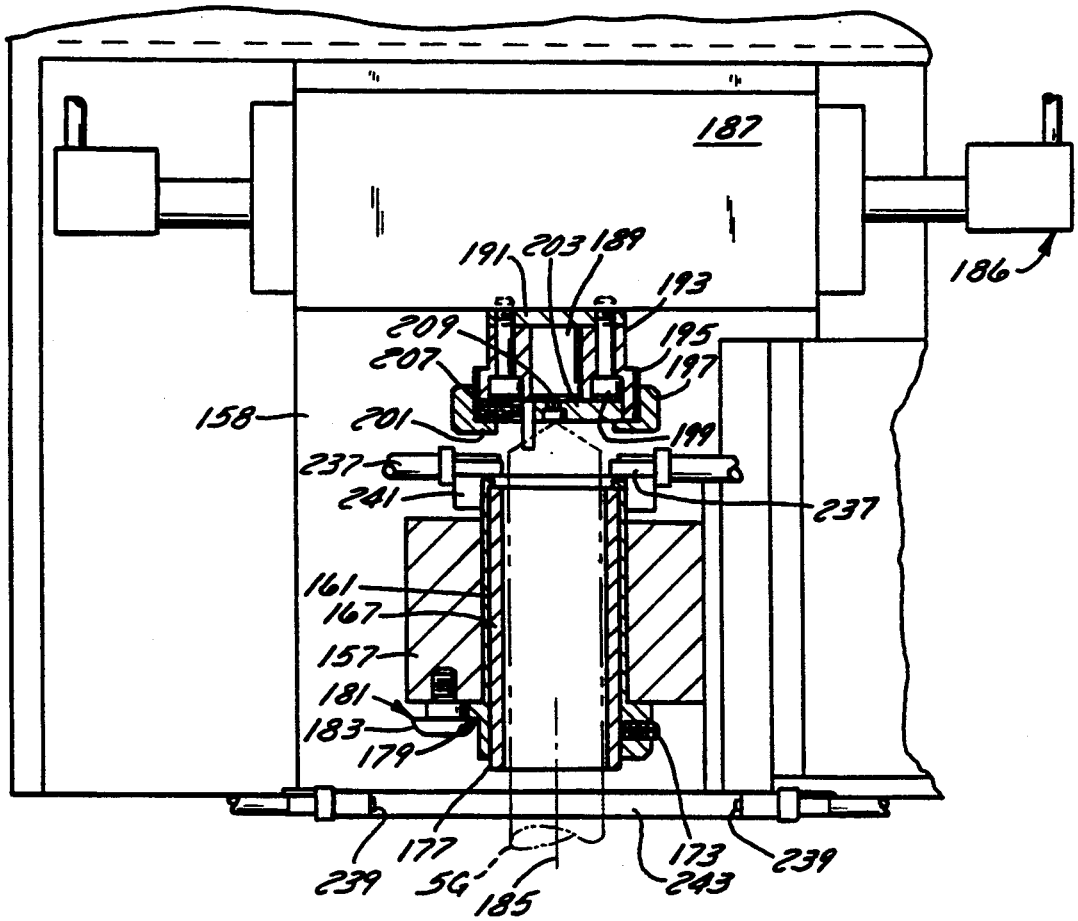
FIG. 10 is an enlarged partial cross sectional view taken along lines 10—10 of FIG. 2.
Figure 14:
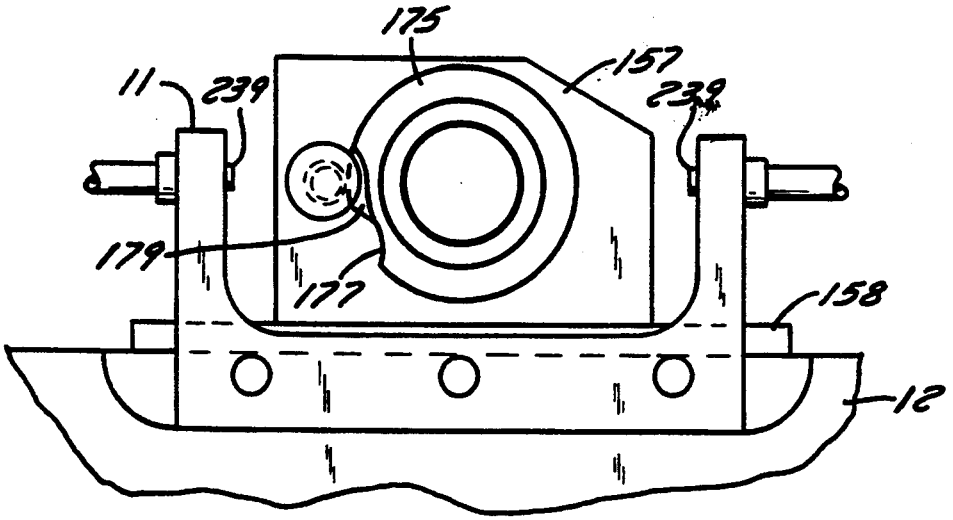
FIG. 14 is a view taken along lines 14—14 of FIG. 11.
Figure 10A:
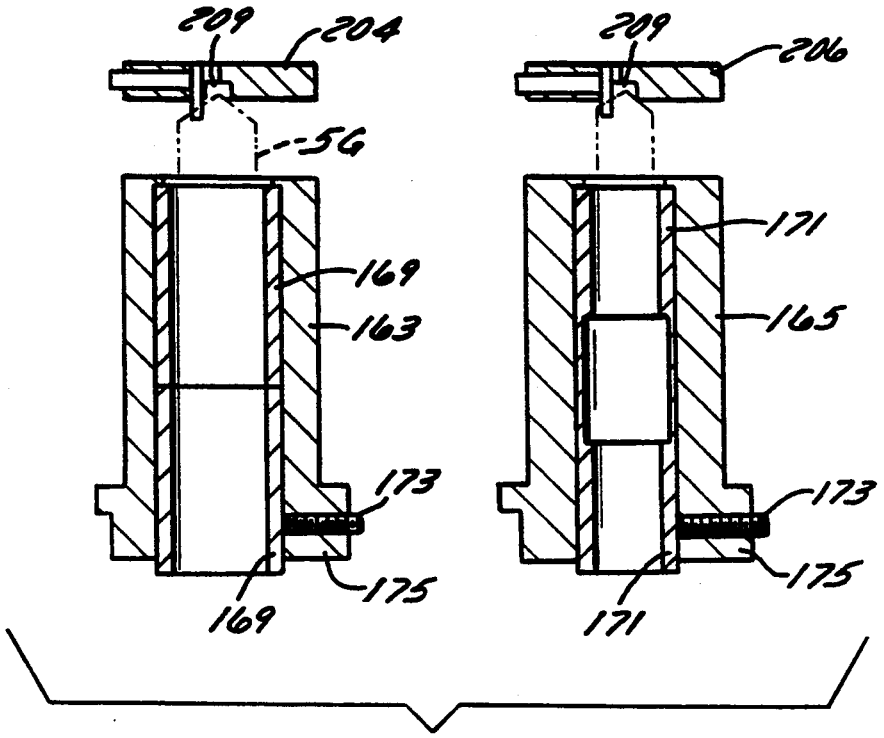
FIG. 10*a* is a cross sectional view of typical alternate bushing holders and timing disks that are used in conjunction with the timing station of the present invention.
Figure 12:
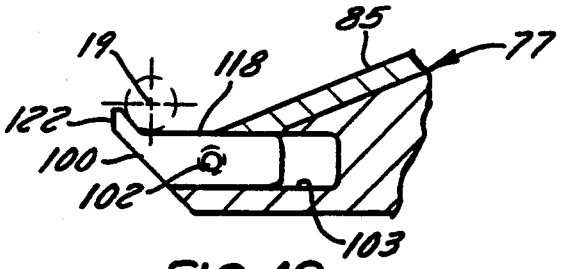
FIG. 12 is a cross sectional view taken along lines 12—12 of FIG. 4.

Mounted to the Y-axis carrier 281 is the drill gripping mechanism 245. Turning also to FIGS. 8 and 9, the drill gripping mechanism 245 is comprised of a base slide 283 that extends generally perpendicular to the plane of the Y-axis carrier 281. That is, the base slide 283 lies principally in an X-Y plane. Conventional fasteners 280 attach an edge surface 282 of the base slide 283 to the Y-axis carrier 281. Preferably, the base slide 283 is manufactured with a base portion 284 and a pair of integral spaced parallel pedestals 285. The pedestals 285, together with the base portion 284, define a channel 287. The pedestals 285 also define a vertical centerline 288 for the drill gripping mechanism 245.

Fastened to the pedestals 285 of the base slide 283 by screws, not shown, is a vertically extending gripper plate 291. The gripper plate 291 cooperates with the base portion 284 and the pedestals 285 of the base slide 283 to surround the channel 287 on four sides.

Pivotally received within the channel 287 of the drill gripping mechanism 245 are a pair of levers 295. The upper end 296 of each lever 295 is pivotable about an associated pin 297. Each pin 297 is supported on its opposite ends by the base portion 284 of the base slide 283 and by the gripper plate 291. The lower ends 299 of the levers 295 protrude below the lower ends of the base slide 283 and of the gripper plate 291.

Received for sliding within the channel 287 of the drill gripping mechanism 245 is the head 301 of a generally T-shaped cam slide 303. An opening 305 is formed through the cam slide head 301. The pins 297 pass through the cam slide opening 305. Machined in the front face of the cam slide 305 are a pair of upwardly converging slots 307. The slots 307 are sized to accept the rollers 309 of associated cam followers 311. The shank 313 of each cam follower 311 is threaded into a corresponding lever 295. By reciprocating the cam slide 303 in Y directions, that is, vertically with respect to FIGS. 8 and 9, the levers oscillate about their respective pins 297. Specifically, sliding the cam slide upwardly with respect to FIGS. 8 and 9 causes the lower ends 299 of the levers to pivot apart in the directions of arrows 315. Sliding the cam slide downwardly with respect to FIG. 8 causes the lever lower ends to pivot toward each other in the directions of arrows 317.

To reciprocate the cam slide 303 and thus oscillate the levers 295, the drill gripping mechanism 245 further comprises a gripper actuator 293. The gripper actuator 293, which may be an air operated cylinder, is fastened to the upper end of the gripper plate 291. A limit switch 371 mounted to the drill gripping mechanism plate 291 controls the operation of the gripper actuator 293. The piston rod 319 of the gripper actuator 293 is connected through a clevice 321 and pin 323 to a T-shaped connector 325. A leg 327 of the connector 325 slides within the channel 287 formed by the gripper plate 291 and the base slide 283. The connector 325 is joined to the head 301 of the cam slide 303 by long screws 329. The first ends of a pair of pins 333 are pressed into associated arms 331 of the connector 325. The second ends of the pins 333 are slidingly received within corresponding ball bearing bushings 335 pressed into the pedestals 285 of the base slide 283. In that manner, actuation of the gripper actuator 293 causes the cam slide 303 to reciprocate and the levers 295 to oscillate in the directions of arrows 315 and 317.

The purpose of the drill gripping mechanism 245 is to selectively grip and release a drill 5. To facilitate that function, the lower ends 299 of the levers 295 are provided with respective interchangeable jaws 339. The jaws 339 have identical attachment sections 341 for attaching to the levers 295. However, the jaws 339 have different sized gripping sections 343. The gripping sections 343 are designed to grip a drill when the levers 295 are pivoted in the directions of arrows 317. The gripping sections 343 of the jaws 339 are sized to grip a range of drill sizes. It is contemplated that two or three sizes of gripping sections 343 are sufficient to handle drills ranging from 6 millimeters to 26 millimeters in diameter.

For safety and other purposes to be explained, the levers 295 are biased to their closed configuration, that is, in the direction of arrows 317. Biasing is achieved through a compression spring 345 set into a recess 347 in the base portion 284 of the base slide 283. The spring 345 acts against a small retainer 346 fastened to the underside of the cam slide 303. The spring urges the cam slide downwardly. As explained previously, downward motion of the cam slide 303 induces the levers 295 to pivot in the directions of arrows 317, that is, to pivot to their closed configuration to grip a drill in the jaws 339. The spring 345 maintains sufficient force on the cam slide to maintain the levers 295 in their closed configuration even if drill gripping force by the gripper actuator 293 is removed.

Figure 15:
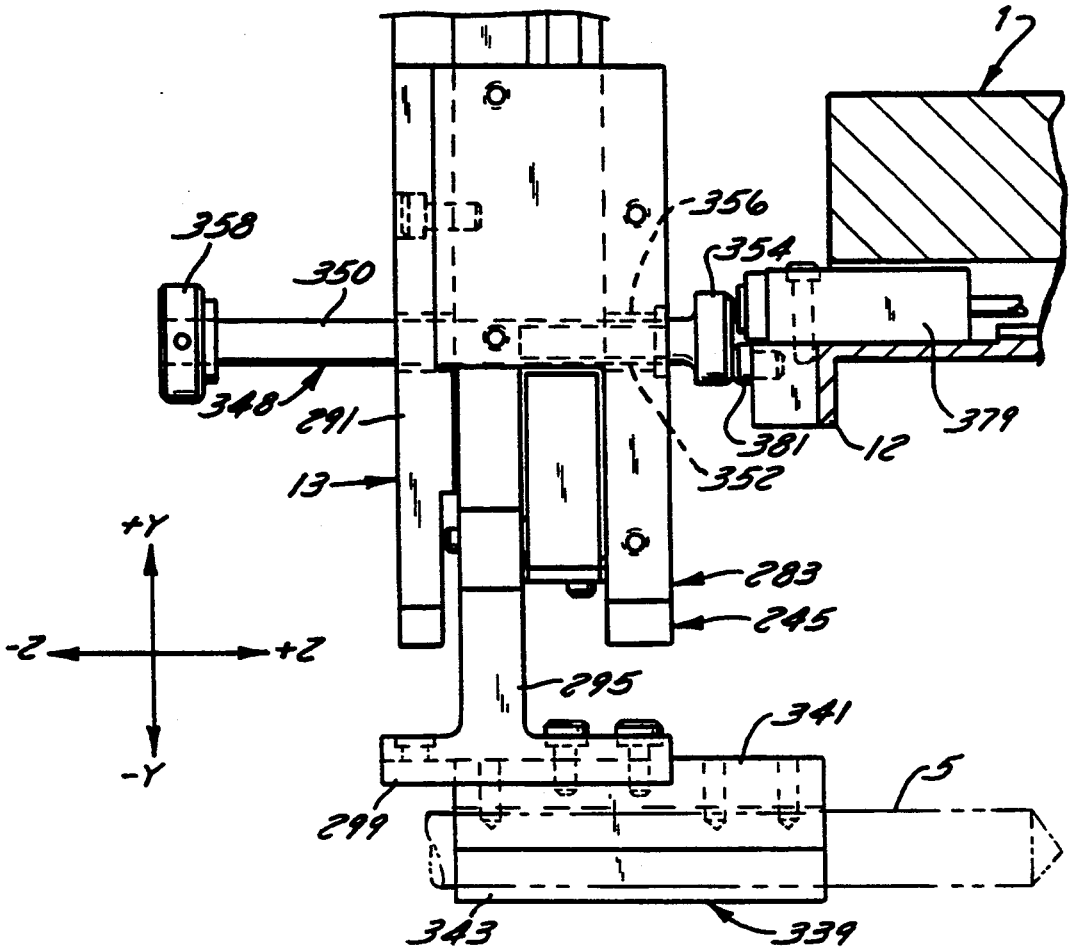
FIG. 15 is a partial cross sectional view taken generally along lines 15—15 of FIG. 2 showing the load gripper drill gripping mechanism at the position of presenting a drill to the drill grinding machine workhead chuck.

Now looking at FIG. 15, a Z-direction adjustment mechanism 348 is incorporated into the load gripper 13 for a purpose to be explained presently. The Z-direction adjustment mechanism 348 is made up of a shaft 350 having a threaded portion 352 and a head 354. The shaft 350 passes through aligned holes in the gripper plate 291 and in the base slide 283. A threaded insert 356 in the base slide 283 mates with the threads 352 on the shaft 350. A knob 358 is placed on the front end of the shaft. By turning the knob 358, the shaft is axially translated in the Z directions relative to the gripper plate 291.

UNLOAD GRIPPER

Figure 5:
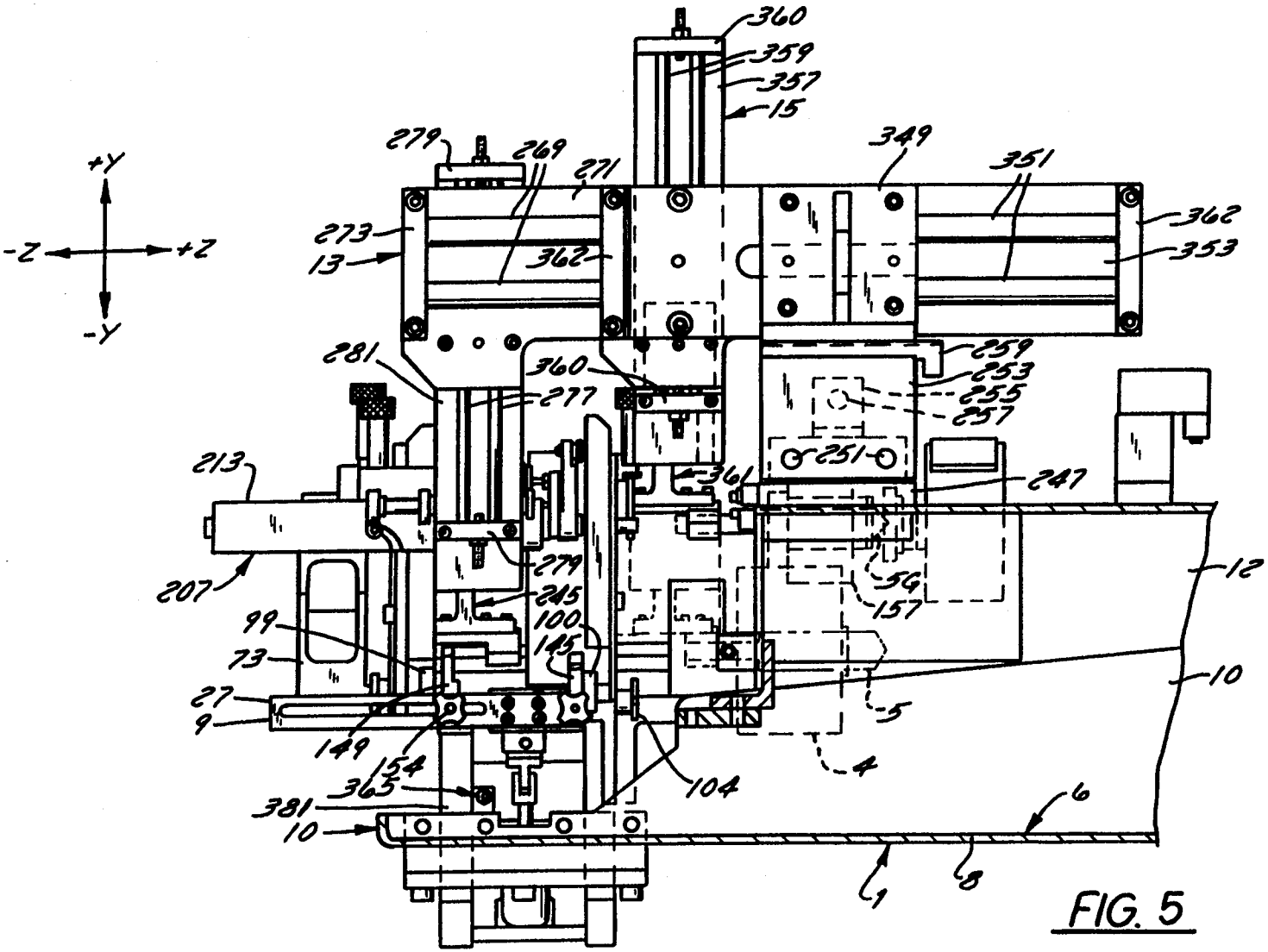
FIG. 5 is a cross sectional view taken along lines 5—5 of FIG. 2.

The unload gripper 15, FIGS. 2, 3, and 5, is used to transport drills 5 from the machine workhead 3 to a storage receptacle 25. The unload gripper 15 is very similar to the load gripper 13. The unload gripper is comprised of a Z-axis power slide 347 mounted to the X-axis carrier 259 by means of an angle plate 349. The Z-axis power slide 347 includes two piston rods 351 that support a Z-axis carrier 353 through end plates 362. The Z-axis power slide 347 can be actuated to horizontally reciprocate the Z-axis carrier 353.

The Z-axis carrier 353 supports a Y-axis power slide 355. In turn, the Y-axis power slide 355 supports a Y-axis carrier 357 through piston rods 359 and end plates 360. Actuation of the Y-axis power slide 355 causes reciprocation of the Y-axis carrier 357.

A drill gripping mechanism 361 is mounted to the Y-axis carrier 357 of the unload gripper 15. The drill gripping mechanism 361 is substantially identical to the drill gripping mechanism 245 described previously in conjunction with FIGS. 8 and 9. However, the drill gripping mechanism 361 does not include the Z-direction adjustment mechanism 348 of FIG. 15.

Like the load gripper 13, most of the components of the unload gripper 15 are made of aluminum.

SETUP AND ADJUSTMENT

As part of the manufacture of the automatic drill loader 1, certain settings are made at the factory. To properly remove a drill 5E from the magazine pickup station 19, the end limit of the stage block 117 in the −X direction and the clockwise rotation of the stage housing 101 must be set. For that purpose, a first limit switch, not shown, is used in conjunction with the first stage actuator 119, and a second limit switch, also not shown, is used in conjunction with the second stage actuator 131. The two limit switches are set together to locate the stage block 117 and the V blocks 145 and 149 proximate and under the drill 5E on the horizontal surfaces 116, 118 of the stops 99, 100, respectively, when the two stage actuators are in their respective retracted positions. Specifically, the two limit switches are set such that the sharp edge 146 of the back V block 145 is vertically in line with the surface 363 of the drill cutting end 5B that is furthest from the machine workhead axis 4. The X-direction location of the front V block 149 is automatically in proper position to suit the drill shank, whether or not the shank is stepped.

Transferring a drill 5E from the pickup station 19 to the staging station 23 requires that the end limit of the first stage actuator 119 in its extended position be set to place the centerline of the V blocks 145 and 149 vertically in line with the staging station. The end limit of the first stage actuator 119 in its extended position is set by adjusting the nuts 129 on the stud 127 associated with the stage housing 101. Normally, the nuts need no further adjustments, because the X-direction location of the staging station is fixed and is independent of the drill diameter.

Transferring a drill 5E from the pickup station 19 to the staging station 23 also requires that the vertical position of the V blocks 145 and 149, as controlled by the extended position of the second stage actuator 131, be carefully set. For that purpose, an adjustment stop 365 in the form of a set screw 367 and a pair of nuts 369 are employed in conjunction with the button 115 on the finger 110 of the stage housing See FIG. 13. The set screw 367 is threaded into a lug 387 that is a part of the magazine housing 29. By adjusting the set screw 367, the end limit of the counterclockwise rotation of the stage housing 101 and of the stage block 117 (as viewed with respect to FIG. 13) is set. The counterclockwise end limit is set to locate the centerline of the V blocks 145 and 149 on the vertical centerline passing through the staging station 23. Like the X-direction adjustment provided the nuts 129 and stud 127, the counterclockwise rotational adjustment of the stage housing provided by the adjustment stop 365 normally needs little or no adjustment after initial setting at the factory.

Although the automatic drill loader 7 is capable of handling a wide range of drill lengths and diameters, only drills having the same cutting end diameter and the same shank end diameter can be handled with one setup. Such individual setups are made by the machine operator. Similarly, the lengths of all the drills for a particular setup must be within two inches of each other. The individual adjustments of the automatic drill loader will be explained in connection with drills 5A having stepped shanks 5C, FIG. 3. For each setup, a series of manual adjustments to the magazine 9, timing station 11, and workhead 3 are required. Although no specific order is required, the following sequence will be found helpful.

The clamps 65 of the magazine 9 are loosened by properly turning the knobs 69, FIG. 6. Then the rails 59 and 61 are slid along the rail guides 45, 47 and the grooves 55, 57, FIG. 2. Sliding the rails simultaneously moves the front-end bracket 73 and the front end plate 74 of the magazine hopper 17 in the Z directions. When the hopper front end plate 74 is in the proper horizontal location to suit the lengths of the drills 5A, the clamps 65 are retightened, FIG. 3. The drills 5A can then be stored in the magazine hopper 17 with their cutting ends 5B supported on the hopper back wear plate 77.

To support the shank ends 5C of the drills 5A in the magazine hopper 17, the front end plate 74 is vertically adjusted by means of the adjustment mechanism 72. Specifically, the knob 80 is turned in the proper direction until the bottom wall 81 of the front wear plate 75 contacts and supports the drill shank ends 5C.

Next, the front and back gates 87 and 89, respectively, of the magazine hopper 17 are adjusted. Those adjustments are accomplished by appropriately turning the screw 95 of the front adjustment mechanism 91 and the screw 97 of the back adjustment mechanism 93. The back gate 89 is adjusted until the drill cutting end 5B of one drill 5A can roll between that gate and the bottom wall 85 of the back wear plate 77. The front gate 87 is adjusted until the drill shank end 5C of a drill 5A rolls proximate the gate 87 when the drill cutting end 5B rolls under the back gate 89.

The front and back stops 99 and 100, respectively, are adjusted to assure that the particular diameter drills 5E are properly located at the magazine pickup station 19, FIGS. 2, 4, 5, 7, and 12. The front stop 99 is adjusted horizontally by means of the knob 128. The front stop is adjusted such that its bumper 120 locates the surface 363 of drill 5E slightly closer to the machine workhead axis 4 than the gates 87 and 89. That is, the drill surface 363 is to the right with respect to FIG. 7 of the gates. Because the front stop 99 is received within the front end plate 74, the front stop moves vertically with the front end plate whenever the front end plate is adjusted by the adjustment mechanism 72 to properly locate the front wear plate 75 to support the shanks 5C of the drills 5A. Accordingly, the vertical level of the front stop horizontal surface 116 is set concurrently and automatically whenever the front end plate is adjusted to suit the drill shanks. The back stop 100 is horizontally adjusted by turning the knob 104. The magazine hopper 17 is now set up to store a quantity of drills 5A having stepped shanks 5C.

If the drills 5A do not have stepped shanks, the front end plate 74 is adjusted by means of the adjustment mechanism 72 such that the front wear plate 75 is coplanar with the back wear plate 77. The horizontal surfaces 116 and 118 of the stops 99 and 100, respectively, are then automatically coplanar. In addition, the opening between the front gale 87 and the bottom wall 81 of the front wear plate is adjusted to be the same as the opening between the back gate 89 and the bottom wall 85 of the back wear plate 77.

The next set of adjustments concerns the magazine staging mechanism 27. Those adjustments are necessary to assure that the various diameter drills that the magazine hopper 17 can store are properly removed from the pickup station 19 and transferred to the staging station 23.

To properly locate the drills 5F of different diameters at the staging station 23, it is necessary to vertically adjust the V blocks 145 and 149. The back knob 147 is loosened to enable the back V block 145 to slide vertically relative to the carrier 141 until the longitudinal axis of the particular drill to be transferred by the stage mechanism 27 is concentric with the staging station 23. Then the back knob 147 is retightened. The front V block 149 is adjusted independently of the back V block 145 by means of the front knob 153. If the drill has a straight shank, the front V block is set at the same vertical setting as the back V block. If the drill has a stepped shank, the front V block is set at an appropriately higher level than the back V block. The front V block is also adjusted along the carrier 141 in the Z directions to suit the length of the drills. After the two V blocks have been properly adjusted, drills of a particular diameter and length are consistently transferable from the pickup station 19 to the staging station 23.

The setup of the timing station 11 requires the insertion of the correct bushing holder 161, 163, or 165 into the timing station housing 157 (FIGS. 10, 10*a*, 11, and 14). The proper sized bushing, such as bushing 167, for the particular drill 5G is then inserted into the bushing holder. Also, the correct disk 203, 204, or 206 is installed in connection with the rotary timing device 186.

The proper sized jaws 339 are attached to the levers 295 of the two drill gripping mechanisms 245 and 361 (FIGS. 2, 8, 9, and 15).

The proper bushing is inserted into the chuck of the machine workhead 3. For example, the chuck bushing may be as is described in U.S. patent application Ser. No. 513,080.

Other adjustments will be explained shortly in connection with the explanation of the operation of the automatic drill loader 7.

OPERATION

After the drill grinding machine 1 and the automatic drill loader 7 are setup and adjusted as previously described, operation of the machine to automatically process drills 5A stored in the magazine 9 can begin. A conventional programmable controller may be used to control the operation of the conventional automatic drill loader by properly actuating the various air cylinder actuators. The limit switches and other sensors provide signals that assure a particular step has been completed before the next step can begin.

The operation of the automatic drill loader 7 will be described as beginning with a drill 5A rolling down the front and back wear plates 75 and 77, respectively, under the gates 87 and 89, onto the stops 99 and 100, and to the pickup station 19. The first and second stage actuators 119 and 131, respectively, of the magazine staging mechanism 27 are actuated to move the stage block 117 with a compound motion to locate the front and back V blocks 149 and 145, respectively, under the drill 5E at the pickup station 19. Then the second stage actuator 131 extends a short amount to pivot the stage housing 101 and the stage block 117 such that the V blocks rise up under and lift the drill 5E from the pickup station. The second stage actuator extends completely, and the first stage actuator extends to transfer the drill to the staging station 23. Meanwhile, a new drill rolls down the front and back wear plates 75 and 77, respectively, of the magazine hopper 17 to the pickup station 19.

While the magazine staging mechanism 27 is transferring a drill 5E to the staging station 23, the load gripper 13 is in its normal X-direction position vertically over the staging station. The load gripper is also in its normal Z-direction position at the −Z-direction limit. In that situation, the jaws 339 of the drill gripping mechanism 245 are overto the drill 5F at the staging station 23.

The gripper actuator 293 of the load gripper drill gripping mechanism 245 is actuated to open the jaws 339, i.e., to pivot the levers 295 in the directions of arrows 315. Then the Y-direction power slide 275 is energized to lower the Y-axis carrier 281 and thus the drill gripping mechanism 245 to a −Y-direction limit. When the Y-axis carrier 281 and the load gripper drill gripping mechanism 245 are at the −Y-direction limit, the jaws 339 surround the drill 5F at the staging station 23 and are located between the V blocks 145 and 149 of the Staging mechanism 27. At that point, the gripper actuator 293 is reversed to close the jaws in the directions of arrows 317 and thereby snugly grip the drill 5F. The Y-axis power slide 275 is then actuated to retract the Y-axis carrier 281 and to raise it and the drill 5F in the +Y direction. The Y-axis power slide 275 is deenergized when the drill axis is concentric with the axis 185 of the timing station 11. At that point, the drill is located at a pre-timing station coincident with the portion 212 of the timing station axis 185 between the timing housing 157 and the pusher mechanism 211. The cutting end of the drill is a short distance in front of the timing station housing 157.

With the drill at the pre-timing station 212, the gripper actuator 293 of the drill gripping mechanism 245 is deactuated to remove the force on the levers 295. However, the gripper actuator is not actuated with a reverse motion that would cause the jaws 339 to open. Rather, the drill remains loosely gripped within the jaws under the force of the spring 345.

The pusher actuator 229 is then actuated to extend the piston rod 221 and with it the yoke 233, pusher shaft 215, and arm 219. As the pusher shaft 215 extends, the groove 223 in the pusher block 213 acts on the shoulder screw 225 screwed into the pusher shaft. The groove 223 and shoulder screw 225 cause the pusher shaft and arm 219 to rotate approximately 90 degrees such that the pusher button 221 is coaxial with the timing station axis 185. Continued extension of the pusher actuator 229 causes the pusher button 221 to ultimately contact the back of the drill shank. The stroke of the pusher shaft 215 is designed to accomodate the two inch variations in length of the drill stored in the magazine hopper 17. Continued operation of the pusher actuator pushes the drill from the pre-timing station 212 into the bushing 167, 169, or 171 in the bushing holder 161, 163, or 165 until the drill cutting tip passes through switch 237, which actuates the rotary drive 187 while the drill is pushed to contact the hardened stop 209 of the timing disk 203, 204, or 206. At that point, the drill 5G is timed in the Z direction, and the rotary drive finishes orientation of the drill angularly in space. The drill is then at a predetermined location in space in the all linear and angular directions.

The rotary drive 187 operates to rotate the disk 203, 204, or 206 a predetermined amount, such as 360 degrees. During such rotation of the disk, the pin 205 engages a flute of the drill and thus rotate the drill with the disk. Consequently, the drill 5G is at a known and predetermined angular orientation in space when the rotary drive 187 ceases its rotation. The drill is then angularly timed. At that point, the pusher actuator 229 retracts the pusher shaft 215 and arm 219 from against the back of the drill. Full retraction of the pusher actuator causes the groove 223 and shoulder screw 225 to swing the arm back to its vertical position. The pusher button 221 is then displaced from the timing station axis 185 and out of the way of the drill. During the timing operation, the staging mechanism 27 withdraws the stage block 117 away from the staging station 23 to underlie a new drill at the pickup station 19.

Next, the gripper actuator 293 is reactuated to again snugly grip the drill 5G. The Z-direction power slide 261 actuates to extend the Z-axis carrier 271 in the −Z direction by an amount sufficient to withdraw the drill 5G from the timing housing 157 and move it back to the pre-timing station 212. When the sensing switches 239 assure that the drill 5G has indeed been removed from the timing housing, the Y-axis power slide 275 is actuated to extend the Y-axis carrier 281 in the −Y direction. The Y-axis power slide is deactuated when the drill is back at the staging station 23. (The stage block 117 is still under the pickup station 19 and away from the staging station 23.) When the machine workhead chuck is ready, the X-axis power slide 255 is actuated to move the X-axis carrier 259 and the timed drill such that the drill longitudinal axis is concentric with the axis of the machine workhead chuck. Then the Z-axis power slide 261 again actuates to retract the Z-axis carrier in the +Z direction and insert the drill 5 into the chuck of the workhead 3.

To control the location of the drill 5 within the workhead chuck, the Z-direction adjustment 348 is utilized. A limit switch 379 and a stop button 381 mounted to the drill grinding machine 1 are used in conjunction with the Z-axis adjustment 348. The stop button 381 is attached to the lid 12 of the drill grinding machine 1. The knob 353 is adjusted to produce contact of the head 354 of the shaft 350 against the stop button 381 when the tip of the drill is at the proper location relative to the machine grinding wheel (not shown). The limit switch 379 is set to trip when the shaft head 354 contacts the stop button 381. Then the workhead chuck grips the drill, the load gripper 13 releases the drill, the Y-axis power slide 271 is actuated to raise the Y-axis carrier 281 to its upper or retracted position, and the grinding cycle can begin.

While the grinding cycle is continuing, the load gripper 13 returns to its normal position vertically over the staging station 23, ready to pick up a fresh drill 5F transferred there in the meantime by the staging mechanism 27. Return to the staging station is achieved by energizing the X-axis actuator 255 to move the X-axis carrier 259 to an end limit set by a −X-direction limit switch, not illustrated in the drawings. The −X-direction limit is set such that the vertical centerline 288 of the drill gripping mechanism 245 is aligned in the X directions with the timing station axis 185 and the staging station 23. The Z-axis power slide 261 is also energized to move the Z-axis carrier 271 in the −Z direction to a limit set by a −Z-direction limit switch. When the Z-axis carrier 271 is at the −Z-direction limit, the jaws 339 of the drill gripping mechanism are over the drill 5F at the staging station 23. The load gripper 13 returns to the staging station directly from the workhead 3 without stopping at the timing station 11.

Simultaneous with the various movements of the load gripper 13 are associated movements of the unload gripper 15. The various components of the automatic drill loader 7 are so dimensioned that the vertical centerline 383 of the unload gripper is aligned with the machine workhead axis 4 when the load gripper vertical centerline 288 is aligned with the timing station axis 185 and the staging station 23. When the load gripper 13 is located such that the timed drill gripped in the jaws 339 is at the staging station 23, the unload gripper is located vertically above the machine workhead 3, as is shown in FIG. 2. Both grippers wait in those locations until the grinding operation is completed on the drill 5.

At the completion of the drill grinding cycle, the Y-axis power slide 355 of the unload gripper 15 is actuated to lower the open jaws 339*a* of the drill gripping mechanism 361 to surround the ground drill 5. The jaws 339*a* close to grip the drill, and the workhead collet releases the drill. Then the Z-axis power slide 347 is actuated to extend the Z-axis carrier 353 in the −Z direction and remove the drill from the workhead chuck. The Y-axis power slide 355 is actuated to return the Y-axis carrier 357 to its upper or retracted position.

It is at that point that the X-axis power slide 255 translates the X-axis carrier 259 in the +X direction to bring the timed drill from the staging station 23 to the machine workhead 3. That X-axis carrier movement simultaneously brings the unload gripper 15 over the storage receptacle 25. The load gripper inserts the fresh drill into the workhead chuck, and the unload gripper releases the finished drill 5H to the receptacle 25. At the same time, the unload gripper Z-axis power slide 347 is actuated to retract the Z-axis carrier 353 in the +Z direction to its retracted position. As the X-axis power slide 255 moves the load gripper 13 in the −X direction by means of the X-axis carrier 259 back toward the staging station 23, the unload gripper 15 simultaneously moves in the −X direction to be vertically over the workhead 3. The unload gripper remains in that location while the load gripper undergoes the various motions to grip another drill at the staging station, convey it to the timing station, and return it to the staging station. At that point, the cycle is complete. The cycle is repeated until all the drills 5A in the magazine hopper 17 are processed.

Thus, it is apparent that there has been provided, in accordance with the invention, an automatic drill loader that fully satisfy the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An automatic drill loader comprising:

a. frame;

b. a magazine mounted to the frame comprising:

i. hopper means for storing a quantity of drills having respective longitudinal axes, cutting ends, and shank ends;

ii. pickup means for receiving a selected drill from the hopper means to support the drill at a predetermined pickup station; and iii. stage means for transferring a drill from the pickup station to a predetermined staging station;

c. timing means mounted to the frame for timing a drill in axial and angular orientations; and d. gripper means mounted to the frame for conveying a drill from the staging station to the timing means and from the timing means to a work station and from the work station to a storage receptacle, the gripper means including a pair of drill gripper assemblies, each drill gripper assembly having a pair of interchangeable jaws.

2. The automatic drill loader of claim 1 wherein the stage means comprises:

a. stage block means for supporting a drill; and b. stage mechanism means for moving the stage block means in a compound motion to lift a drill off the pickup station and to transfer the drill to the staging station.

3. The automatic drill loader of claim 2 wherein the stage block means comprises:

a. a carrier supported by the stage mechanism means and having a length at least as long as the drills stored in the magazine hopper means; and b. block means mounted to the carrier for cradling the drill at the pickup station.

4. The automatic drill loader of claim 3 wherein the block means comprises first and second V blocks mounted to the carrier, each V block being adjustable relative to the carrier to enable drills having different lengths and different diameters to be lifted from the pickup station and transferred to the staging station.

5. The automatic drill loader of claim 2 wherein the stage mechanism means comprises:

a. a stage housing pivotally mounted to the frame;

b. rod means for reciprocatingly supporting the stage block means on the stage housing;

c. first stage actuator means for reciprocating the stage block means relative to the stage housing; and d. second stage actuator means for pivoting the stage housing relative to the frame and for cooperating with the first stage actuator means to produce combined translational and pivotal motions to the stage block means that lift a drill from the pickup station and transfer it to the staging station.

6. The automatic drill loader of claim 1 wherein the timing means comprises:

a. drill orientation means mounted to the frame for locating a drill angularly and linearly at a predetermined location in space;

b. bushing means having a longitudinal axis mounted to the frame for guiding drills to the drill orientation means;

c. a pre-timing station located concentric with the bushing means, the gripper means conveying a drill from the staging station to the pre-timing station; and d. pusher means for pushing a drill in the gripper means from the pre-timing station into the bushing means and against the drill orientation means.

7. The automatic drill loader of claim 6 wherein the pusher means comprises:

a. a pusher block mounted to the magazine;

b. pusher shaft means supported by the pusher block for axially moving along an axis parallel to and eccentric to the longitudinal axis of the bushing means;

c. arm means mounted to the pusher shaft means for selectively contacting a drill located at the pre-timing station by the gripper means; and d. means for rotating the pusher shaft means and the arm means simultaneously with axial movement of the pusher shaft means to cause the arm means to contact the drill conveyed to the pre-timing station by the gripper means, the arm means pushing the drill into the bushing means and against the drill orientation means in response to continued axial movement of the pusher shaft means.

8. The automatic drill loader of claim 1 wherein the gripper means comprises:

a. load gripper means for conveying a drill from the staging station to the timing station and from the timing station to a work station; and b. unload gripper means for carrying a drill from the work station to the storage receptacle.

9. The automatic drill loader of claim 8 wherein the load gripper means comprises:

a. a first power slide mounted to the frame;

b. first carrier means for being reciprocated in first horizontal directions by the first power slide;

c. a second power slide mounted to the first carrier means;

d. second carrier means for being reciprocated in second horizontal directions generally perpendicular to the first horizontal directions by the second power slide;

e. a third power slide mounted to the second carrier means;

f. third carrier means for being reciprocated in generally vertical directions by the third power slide; and g. first drill gripping means mounted to the third carrier means for selectively gripping and releasing a drill, the first, second, and third power slides and the first drill gripping means being selectively actuated to enable the first drill gripping means to grip a drill at the staging station, convey the drill to the timing station and from the timing station to the work station, release the drill at the work station, and return to the staging station to grip another drill.

10. The automatic drill loader of claim 9 further comprising drill location means mounted to the first drill gripping means for adjustably controlling the location of the drill at the work station.

11. The automatic drill loader of claim 9 wherein the unload gripper means comprises:

a. a fourth power slide mounted to the first carrier means;

b. fourth carrier means for being reciprocated. by the fourth power slide in the second horizontal direction independently of the reciprocation of the second carrier means;

c. a fifth power slide mounted to the fourth carrier means;

d. fifth carrier means for being reciprocated in generally vertical directions by the fifth power slide independently of the reciprocation of the third carrier means; and e. second drill gripping means mounted to the fifth carrier means for selectively gripping and releasing a drill, the first, fourth, and fifth power slides and the second drill gripping means being selectively actuated to enable the second drill gripping means to grip a drill at the work station and carry the drill from the work station to the storage receptacle.

12. The automatic drill loader of claim 9 wherein the first drill gripping means comprises:

a. plate means fastened to the third carrier means;

b. cam slide means for reciprocating along the plate means; and c. lever means pivotally mounted to the plate means for oscillating between closed and open configurations to grip and release a drill, respectively, in response to reciprocation of the cam slide means.

13. The automatic drill loader of claim 12 wherein:

a. the cam slide means is fabricated with a pair of converging slots;

b. the lever means comprises:

i. a pair of levers having respective first ends pivotally mounted to the plate means and respective second ends;

ii. a jaw attached to the second end of each lever, the jaws of the two levers being cooperable with each other to grip a drill therebetween; and iii. a roller mounted in each lever and riding in an associated slot in the cam slide means, so that reciprocation of the cam slide means causes the levers to oscillate and the jaws thereon to grip and release a drill.

14. The automatic drill loader of claim 12 further comprising biasing means acting between the cam slide means and the plate means for biasing the lever means to the closed configuration thereof.

15. An automatic drill loader comprising:.

a. a frame;

b. a magazine mounted to the frame comprisingl i. hopper means for storing a quantity of drills having respective longitudinal axes, cutting ends, and shank ends;

ii. pickup means for receiving a selected drill from the hopper means to support the drill at a predetermined pickup station; and iii. stage means for transferring a drill from the pickup station to a predetermined staging station;

c. timing means mounted to the frame for timing a drill in axial and angular orientations; and d. gripper means mounted to the frame for conveying a drill from the staging station to the timing means and from the timing means to a work station and station to a storage receptacle, wherein the magazine hopper means comprises:

a. back end plate means stationarily secured to the frame for supporting the cutting ends of the drills; and b. front end plate means movably secured to the frame at selected locations for supporting the shank ends of the drills at variable distances from the back end plate means and for cooperating with the back end plate means to enable drills having different lengths to be stored in the hopper means when the front end plate means is secured to the frame at a selected location.

16. The automatic drill loader of claim 15 wherein:

a. the magazine hopper means front end plate means and back end plate means are sloped to enable drills stored in the hopper means to roll therefrom to the pickup means; and b. the hopper means further comprisingl gate means connected to the back end plate means and to the front end plate means for limiting one drill at a time to roll from being supported by the back end plate means and the front end plate means to be supported by the pickup means.

17. The automatic drill loader of claim 16 within the gate means comprises:

a. a back gate connected to the back end plate means for vertical adjustment relative thereto; and b. a front gate connected to the front end plate means for vertical adjustment relative thereto, the front and back gates being adjustable to limit one drill at a time to roll between the gates and the respective front and back end plate means to the magazine pickup means, so that the drills roll in a controlled manner from being supported by the magazine hopper means front and back end plate means to being supported by the pickup means.

18. The automatic drill loader of claim 15 wherein:

a. the back end plate means comprises:

i. a generally vertical back end plate stationarily secured to the frame; and ii. a back wear plate joined to the back end plate, the back wear plate having a sloped back wall and a sloped bottom wall, the cutting ends of the drills being supported on the back wear plate with the longitudinal axes of the drills being generally horizontal and perpendicular to the back end plate; and b. the front end plate means comprises:

i. a front end bracket mounted to the frame for movement relative thereto in first directions generally parallel to the longitudinal axes of the drills stored in the magazine hopper means;

ii. a front end plate mounted to the front end bracket and being generally parallel to the back end plate; and iii. a front wear plate joined to the front end plate, the front wear plate having a sloped back wall and a sloped bottom wall, the shank ends of the drills being supported on the front wear plate, wherein the front end plate is adjustable in generally vertical directions relative to the back end plate to thereby enable the front wear plate to support the shank ends of stepped shank drills.

19. The automatic drill loader of claim 18 further comprising:

a. a back gate connected to the back end plate for vertical adjustment relative thereto; and b. a front gate connected to the front end plate for vertical adjustment relative thereto, the front and back gates being adjustable vertically relative to each other to enable drills having stepped shanks to roll one at a time between the gates and the respective wear plates of the front and back end plates to the magazine pickup means.

20. The automatic drill loader of claim 15 further comprising rail means slidingly supported by the back end plate means and by the frame for selectively moving the front end plate means in directions generally parallel to the longitudinal axes of the drills stored in the magazine hopper means, so that sliding the rail means adjusts the front end plate means relative to the back end plate means to enable the magazine hopper means to store drills of different lengths.

21. The automatic drill loader of claim 15 wherein the pickup means comprises stop means mounted to the back end plate means and to the front end plate means for being horizontally adjusted relative thereto to enable drills of different diameters to be received from the hopper means and located at the predetermined pickup station.

22. In combination with a drill grinding machine having a frame, a lid, and a workhead chuck with a horizontal longitudinal axis, an automatic drill loader for presenting drills to the workhead chuck for being ground thereat and for removing ground drills therefrom comprising:

a. magazine means mounted to the drill grinding machine frame for storing a quantity of drills to be ground, the longitudinal axis of the drills being parallel to the longitudinal axis of the drill grinding machine workhead chuck;

b. timing means attached to the drill grinding machine lid for orienting a drill to be ground in a predetermined angular and axial location in space; and c. gripper means mounted to the drill grinding machine lid for cyclically transporting drills to be ground in selected lineal directions parallel and perpendicular to the axis of the drill grinding machine workhead chuck from the magazine means to the timing means and from the timing means to the drill grinding machine workhead chuck and from the drill grinding machine workhead chuck to a storage receptacle.

23. The combination of claim 22 wherein the magazine means comprises:

a. a housing mounted to the drill grinding machine frame;

b. hopper means mounted to the housing for storing a quantity of drills with the longitudinal axes thereof generally parallel to the longitudinal axis of the drill grinding machine workhead chuck;

c. pickup means for receiving drills from the hopper means and for supporting and locating the drills at a predetermined pickup station; and d. stage means for transferring drills from the pickup station to a predetermined staging station.

24. The combination of claim 23 wherein the hopper means comprises:

a. a back end plate fixed to the magazine frame and lying in a plane generally perpendicular to the axis of the drill grinding machine workhead chuck;

b. back wear plate means joined to the back end plate for supporting the cutting ends of the drills;

c. rail means movably supported by the magazine housing for sliding in directions generally parallel to the longitudinal axis of the drill grinding machine workhead chuck;

d. front end plate means joined to the rail means for movement therewith; and e. front wear plate means joined to the front end plate means for supporting the shank ends of the drills, so that the spacing between the back end plate and the front end plate means can be varied by sliding the rails along the magazine housing to enable drills of different lengths to be stored in the magazine hopper means.

25. The combination of claim 24 wherein the front end plate means comprises:

a. a front bracket joined to the rail means;

b. a front end plate lying in a plane generally parallel to the back end plate, the front wear plate means being joined to the front end plate; and c. front adjustment means for adjustably supporting the front end plate on the front bracket to provide vertical adjustment of the front end plate relative to the back end plate, so that the front end plate can be adjusted to enable the front wear plate means to support the shank ends of stepped shank drills.

26. The combination of claim 24 wherein:

a. the back wear plate means and the front wear plate means have respective back and sloped bottom walls, the back and bottom walls of the back wear plate means supporting the cutting ends of the drills stored in the hopper means and the back and bottom walls of the front wear plate means supporting the shank ends of the drills stored in the hopper means, the drills tending to roll transversely from the hopper means to the pickup means; and b. the hopper means further comprises gate means for controlling the drills in the hopper means to roll one at a time from the hopper means to the pickup means.

27. The combination of claim 26 wherein the gate means comprises:

a. back gate means connected to the back end plate means for adjustably controlling the rolling of the cutting ends of the drills from the hopper means to the pickup means; and b. front gate means connected to the front end plate means for adjustably controlling the rolling of the shank ends of the drills from the hopper means to the pickup means.

28. The combination of claim 27 wherein the front gate means is adjustable independently of the back gate means to thereby enable the front and back gate means to control the rolling of drills with stepped shanks from the hopper means to the pickup means.

29. The combination of claim 24 wherein the pickup means comprises:

a. a back stop joined to the back end plate and having an upper surface and a bumper; and b. a front stop joined to the front end plate means and having an upper surface generally coplanar with the upper surface of the back stop and a bumper, the back and front stops being adjustable horizontally relative to the back and front end plates, respectively, to enable drills of different diameters to be located at the pickup station.

30. The combination of claim 29 wherein the back and front stops are adjustable horizontally relative to each other to enable drills having stepped shanks to be located at the pickup station.

31. The combination of claim 23 wherein the stage means comprises:

a. stage block means for cradling a drill;

b. stage housing means pivotally mounted to the magazine housing for supporting the stage block means; and c. stage actuator means acting between the magazine housing, the stage housing means, and the stage block means for imparting a compound motion to the stage block means to enable the stage block means to cradle a drill and lift it from the pickup station and to transfer it to the staging station.

32. The combination of claim 31 wherein the stage actuator means comprises:

a. first stage actuator means for imparting reciprocating motion to the stage block means relative to the stage housing means; and b. second stage actuator means for imparting pivotal motion to the stage housing means relative to the magazine housing, the first and second stage actuator means cooperating to impart the selected compound motion to the stage block means to enable the stage block means to cradle and lift a drill from the pickup station and transfer it to the staging station.

33. The combination of claim 31 wherein the stage block means comprises:

a. stage carrier means supported by the stage housing means for reciprocation relative thereto;

b. a back V block mounted to the stage carrier means for cradling the cutting end of a drill; and c. a front V block mounted to the stage carrier means for cradling the shank end of a drill, the front V block being adjustable along the stage carrier means in directions generally parallel to the axis of the drill grinding machine workhead chuck to enable the stage means to lift drills of different lengths from the pickup station and transfer them to the staging station.

34. The combination of claim 33 wherein the back and front V blocks are adjustable in vertical directions relative to the stage carrier means to thereby enable the staging means to transfer drills of different diameters from the pickup station to the staging station.

35. The combination of claim 33 wherein the back and front V blocks are independently adjustable in vertical directions relative to each other and to the stage carrier means to thereby enable the stage means to transfer drills of different diameters and with stepped shanks from the pickup station to the staging station.

36. The combination of claim 22 wherein the timing means comprises:

a. a timing housing attached to the drill grinding machine lid and having a longitudinal axis parallel to the axis of the drill grinding machine workhead chuck, the timing station longitudinal axis defining a pre-timing station that lies outside of the timing housing;

b. bushing means removably insertable into the timing housing for receiving drills of associated diameters;

c. timing disk means mounted to the drill grinding machine lid for angularly and linearly orienting a drill in space; and d. pusher means for pushing a drill gripped by the gripper means at the timing means from the pretiming station into the timing housing and into contact with the timing disk means.

37. The combination of claim 36 wherein the pusher means comprises:

a. a pusher shaft extending generally parallel to the timing housing longitudinal axis;

b. an arm having a first end fastened to the pusher shaft and a second end;

c. pusher actuator means for axially moving the pusher shaft toward and away from the timing housing; and d. helical means coacting between the pusher actuator means and the pusher shaft for rotating the shaft simultaneously with the axial movement thereof toward the timing housing to locate the arm second end coaxially with the timing housing longitudinal axis, the arm pushing a drill from the pretiming station into the timing housing and into contact with the timing disk means in response to continued axial movement of the pusher shaft toward the timing housing.

38. The combination of claim 22 wherein the gripper means comprises:

a. load gripper means for transporting a drill from the magazine means to the timing station and from the timing station to the drill grinding machine workhead chuck; and b. unload gripper means for carrying a drill from the drill grinding machine workhead chuck to the storage receptacle.

39. The combination of claim 38 wherein the load gripper means comprises:

a. a first carrier;

b. first power slide means mounted to the drill grinding machine lid for reciprocating the first carrier in horizontal directions perpendicular to the longitudinal axis of the drill grinding machine workhead chuck;

c. a second carrier;

d. second power slide means mounted to the first carrier for reciprocating the second carrier in horizontal directions parallel to the longitudinal axis of the drill grinding machine workhead chuck;

e. a third carrier;

f. third power slide means mounted to the second carrier for reciprocating the third carrier in vertical directions; and g. first drill gripping means attached to the third carrier for selectively gripping and releasing a drill, the first, second, and third power slide means being selectively actuable to reciprocate the first drill gripping means in three mutually perpendicular directions to enable the first drill gripping mechanism to transport drills from the magazine means to the timing means and from the timing means to the drill grinding machine workhead chuck.

40. The combination of claim 39 wherein the first drill gripping means:

a. a cam slide;

b. channel means attached to the third carrier for guiding the cam slide for reciprocation therein;

c. gripper actuator means mounted to the channel means for reciprocating the cam slide; and d. lever means connected to the channel means for oscillating between opened and closed configurations to release and grip a drill, respectively, in response to reciprocation of the cam slide, so that selected actuation of the gripper actuator means causes the first drill gripping means to selectively grip and release a drill.

41. The combination of claim 40 further comprising means for biasing the lever means to the closed configuration thereof.

42. The combination of claim 40 wherein the lever means comprises:

a. first and second levers having respective first and second ends, the first ends of the respective levers being pivotally connected to the channel means; and b. first and second jaws secured to the second ends of the respective levers, the jaws being sized and shaped to grip drills having a predetermined range of diameters.

43. The combination of claim 40 wherein:

a. the cam slide is fabricated with a pair of converging slots; and b. the lever means comprises roller means for engaging associated slots of the cam slide, the slots of the cam slide and the roller means of the lever means cooperating to cause the levers to oscillate about their respective first ends in response to reciprocation of the cam slide.

44. The combination of claim 39 wherein the unload gripper means comprises:

a. a fourth carrier;

b. fourth power slide means mounted to the first carrier for reciprocating the fourth carrier in horizontal directions parallel to the longitudinal axis of the drill grinding machine workhead chuck;

c. a fifth carrier;

d. fifth power slide means mounted to the fourth carrier for reciprocating the fifth carrier in vertical direction; and e. second drill gripping means attached to the fifth carrier for selectively gripping and releasing a drill, the first, fourth, and fifth power slide means being selectively actuable to reciprocate the second drill gripping means in three mutually perpendicular directions to carry drills from the drill grinding machine workhead chuck to the storage receptacle.

45. The combination of claim 38 further comprising gripper adjustment means mounted to the first drill gripping means for controlling the location of the drill at the drill grinding machine workhead chuck.

46. The combination of claim 38 wherein:

a. a stop button is mounted to the drill grinding machine; and b. the first drill gripping means comprises adjustment means for cooperating with the stop button to control the location of the drill at the drill grinding machine workhead chuck.

47. A method of loading drills into and unloading drills from a drill grinding machine workhead chuck having a horizontal longitudinal axis comprising the steps of:

a. storing a quantity of drills in a magazine with the longitudinal axes of the drills being generally parallel to the axis of the drill grinding machine workhead chuck;

b. conveying a first drill from the magazine to a timing station;

c. timing the first drill at the timing station;

d. gripping the first drill with a first gripper and transporting the first drill from the timing station to the drill grinding machine workhead chuck for being ground thereat; and e. gripping a second drill with a second gripper and carrying the second drill from the workhead chuck to a storage receptacle.

48. The method of claim 47 wherein:

a. the step of conveying the first drill from the magazine to the timing station comprises the step of conveying the first drill from the magazine to a pre-timing station; and b. the step of timing the first drill comprises the steps of:

i. providing a timing disk to angularly and axially orient a drill in space; and ii. pushing the first drill from the pretiming station into contact with the timing disk.

49. The method of claim 47 wherein the step of transporting a first drill from the timing station to the drill grinding machine workhead chuck and carrying a second drill from the drill grinding machine workhead chuck to the storage receptacle comprises the steps of:

a. providing a first gripper;
b. gripping the first drill at the timing station with the first gripper;
c. providing a second gripper;
d. gripping the second drill in the drill grinding machine workhead chuck with the second gripper;
e. transporting the first drill to the drill grinding machine workhead chuck with the first gripper; and
f. carrying the second drill to the storage receptacle with the second gripper.

50. A method of loading drills into and unloading drills from a drill grinding machine workhead chuck having a horizonal longitudinal axis comprising the steps of:

a. storing a quantity of drills in a magazine with the longitudinal axes of the drills being generally parallel to the axis of the drill grinding machine workhead chuck;
b. conveying a first drill from the magazine to a timing station;
c. timing the first drill at the timing station; and
d. transporting the first drill from the timing station to the drill grinding machine workhead check for being ground thereat; and carrying a second drill from the workhead chuck to a storage receptacle, wherein the step of storing a quantity of drills in a magazine comprises the steps of:
a. providing a magazine hopper having horizontally spaced apart end plates and sloped wear plates attached to the respective end plates;
b. supporting the drills on the magazine hopper wear plates for rolling transversely therealong;
c. providing gates on the respective magazine hopper end plates; and
d. vertically adjusting the gates of the magazine hopper end plates to control the drills to roll one at a time from the magazine hopper to a first predetermined location.

51. The method of claim 50 to comprising the further step of adjusting the vertical distance between the magazine hopper end plates to enable drills having two diameters to be supported on the wear plates of the magazine hopper.

52. The method of claim 50 wherein the step of conveying the first drill from the magazine to the timing station comprises the steps of:

a. transferring the first drill from the first predetermined location to a second predetermined location; and
b. gripping the first drill at the second predetermined location and conveying the drill to the timing station.

53. A method of storing and removing cylindrical objects with their longitudinal axes horizontal comprising the steps of:

a. providing first and second plates;
b. joining first and second sloped walls to the respective end plates;
c. providing first and second gates on the respective first and second end plates;
d. supporting the ends of the objects on the first and second sloped walls for rolling down the sloped walls;
e. vertically adjusting the first and second gates to enable one object at a time to roll between the first and second sloped walls and the respective gates; and
f. vertically adjusting the first end plate relative to the second end plate and vertically adjusting the first gate relative to the second gate to enable an object having at least two different diameters to be supported on the sloped walls and to roll with control between the first and second sloped walls and the respective gates.

* * * * *